US008997643B2

(12) United States Patent
Hallman et al.

(10) Patent No.: US 8,997,643 B2
(45) Date of Patent: Apr. 7, 2015

(54) WASTE CONTAINMENT APPARATUS

(75) Inventors: David Hallman, Innerkip (CA); Dean Loebach, Cambridge (CA)

(73) Assignee: DH Design Solutions Inc. (CA)

( * ) Notice: Subject to any disclaimer, the term of this patent is extended or adjusted under 35 U.S.C. 154(b) by 645 days.

(21) Appl. No.: 12/576,547

(22) Filed: Oct. 9, 2009

(65) Prior Publication Data

US 2010/0089259 A1 Apr. 15, 2010

Related U.S. Application Data

(60) Provisional application No. 61/104,437, filed on Oct. 10, 2008.

(51) Int. Cl.

| | |
|---|---|
| ***B30B 9/00*** | (2006.01) |
| ***B65F 1/12*** | (2006.01) |
| ***B65F 1/14*** | (2006.01) |
| ***B30B 9/30*** | (2006.01) |

(52) U.S. Cl.

CPC ..... *B30B 9/3046* (2013.01); *B30B 9/3039* (2013.01); *B30B 9/3082* (2013.01)

(58) Field of Classification Search

USPC ..... 100/100, 188 R, 215, 226, 229 A, 233, 100/255, 295; 220/908; 414/406, 525.4, 414/525.5, 525.51, 525.52, 525.53, 525.54, 414/525.55

See application file for complete search history.

(56) References Cited

U.S. PATENT DOCUMENTS

| | | | | |
|---|---|---|---|---|
| 3,363,847 A | | 1/1968 | Joa | |
| 3,625,140 A | * | 12/1971 | Glanz | 100/100 |
| 3,654,988 A | * | 4/1972 | Clayton, III | 165/219 |
| 3,709,389 A | * | 1/1973 | Steltz | 414/408 |
| 3,823,972 A | | 7/1974 | Ramer | |
| 3,881,407 A | * | 5/1975 | Goar | 100/35 |
| 3,942,430 A | * | 3/1976 | Day et al. | 100/52 |
| 4,070,962 A | * | 1/1978 | Peterson | 100/209 |

(Continued)

FOREIGN PATENT DOCUMENTS

| | | |
|---|---|---|
| CN | 201217555 Y | 4/2009 |
| DK | 200000764 L | 11/2001 |

(Continued)

OTHER PUBLICATIONS

Compacting Dumpsters, www.wastecare.com, WasteCare Corporation, Gainesville, United States of America.

(Continued)

*Primary Examiner* — Jimmy T Nguyen
(74) *Attorney, Agent, or Firm* — Ostrolenk Faber LLP

(57) ABSTRACT

A waste containment apparatus fits within, the same physical envelope as a typical 6 cubic yard bin. The apparatus has lifting fittings to permit conventional lifting and dumping by a garbage truck. The bin has, internally, a compactor including a motor and a compaction head driven by the motor. The unit has a single point power connection. The working mechanical assemblies and the electrical control unit are mounted well above the inlet chute. The inlet chute is a front or rear access chute, such that the lifting height of the inlet chute is significantly lower than the top opening level of the bin generally. The unit has an internal refuse flow accumulation path, and internal members such as deflector plates oriented to urge the refuse to fill and compact more evenly than otherwise. The unit may have a liquid drain and collection sump. The sump may have a sump heater.

36 Claims, 14 Drawing Sheets

(56) References Cited

U.S. PATENT DOCUMENTS

| | | | | |
|---|---|---|---|---|
| 4,088,071 | A | | 5/1978 | Cruse et al. |
| 4,103,608 | A | | 8/1978 | Chenot |
| 4,130,054 | A | | 12/1978 | Tashman |
| 4,183,295 | A | * | 1/1980 | Peterson ..... 100/345 |
| 4,257,322 | A | * | 3/1981 | McDermott ..... 100/229 A |
| 4,290,352 | A | * | 9/1981 | Schmidt et al. ..... 100/100 |
| 4,552,061 | A | | 11/1985 | Brutsman |
| 4,603,625 | A | | 8/1986 | Brown |
| 4,748,905 | A | | 6/1988 | Langdon |
| 4,953,109 | A | | 8/1990 | Burgis |
| 5,016,197 | A | | 5/1991 | Neumann et al. |
| 5,042,374 | A | | 8/1991 | Klepacki |
| 5,083,510 | A | | 1/1992 | Hohlt |
| 5,173,866 | A | | 12/1992 | Neumann et al. |
| 5,299,493 | A | | 4/1994 | Durbin et al. |
| 5,303,642 | A | | 4/1994 | Durbin et al. |
| 5,317,963 | A | | 6/1994 | Hohlt |
| 5,517,907 | A | | 5/1996 | Fox |
| 5,558,013 | A | | 9/1996 | Blackstone, Jr. |
| 5,588,358 | A | | 12/1996 | Klepacki et al. |
| 5,690,025 | A | | 11/1997 | Hawkins |
| 5,884,556 | A | | 3/1999 | Klepacki et al. |
| 5,967,028 | A | | 10/1999 | Schomisch et al. |
| 6,158,336 | A | * | 12/2000 | Cambiano ..... 100/345 |
| 6,296,132 | B1 | | 10/2001 | Pickler |
| 6,305,278 | B1 | | 10/2001 | Freeberg |
| 6,360,186 | B1 | | 3/2002 | Durbin |
| 6,408,261 | B1 | | 6/2002 | Durbin |
| 6,453,270 | B1 | | 9/2002 | Durbin |
| 6,687,656 | B2 | | 2/2004 | Durbin et al. |
| 6,702,135 | B2 | | 3/2004 | Pickler |
| 7,083,060 | B2 | | 8/2006 | Pickler |
| 7,415,925 | B2 | | 8/2008 | Fox |
| 2008/0041246 | A1 | | 2/2008 | Fox |

FOREIGN PATENT DOCUMENTS

| | | |
|---|---|---|
| JP | 6247502 | 6/1994 |
| NL | 1008821 | 7/1998 |
| WO | 0206039 A1 | 1/2002 |

OTHER PUBLICATIONS

Marathon Equipment Company—Ramjet—Pak'ntainer.

* cited by examiner

WASTE CONTAINMENT APPARATUS

This application claims the benefit under 35 USC 120, or the benefit under the Paris Convention, as may be, of U.S. Provisional patent application Ser. No. 61/104,437 of the same title, filed Oct. 10, 2008, the specification of which is incorporated herein by reference.

FIELD OF INVENTION

This application relates to the field of waste containment apparatus.

BACKGROUND OF THE INVENTION

Waste containment and removal is a common activity at many commercial enterprises, such as restaurants, gas stations, apartment buildings, shopping malls and the like. The waste is often collected in large waste containment, a common example being a 6-yard bin i.e., a receptacle that has a nominal capacity of six cubic yards. Waste disposal is often a problem for businesses such as restaurants, gas stations, and convenience stores. There are many problems or disadvantages with the current method of collection and disposal of waste using a conventional steel bin. Typically bins have volumes of about 4, 6 or 8 cubic yards. These bins may tend to be emptied 2 or 3 times per week. The cost of having the bins emptied has been increasing.

Waste generated during the day-to-day operation of the commercial enterprise such as a fast food restaurant, is commonly removed from the restaurant and placed in a 6-yard bin located outside the building. When the bin is full, a waste collection pick-up is scheduled. Commercial enterprises typically pay for waste removal on a per pick-up basis. The frequency of waste pick-ups may depend on the rate of waste generation of the restaurant as well as the gross volume of waste that can be contained within the 6-yard bin. Reduced pick-up frequency may also reduce disturbances in the parking lot, drive-through line, and so on.

One method of reducing the waste disposal costs of an enterprise is to increase the amount of waste contained within a given 6-yard bin. Fast food restaurant waste is often low density waste that may be suitable for compaction.

Waste containers may be considered unsightly and are often housed within a surrounding enclosure. In some instances, the surrounding enclosure is located at the back of the property, separate from the restaurant, in a shed such as may tend to keep sea gulls, pigeons, skunks, raccoons and other vermin out. The shed may be wooden, and may have front opening gates by which restaurant employees can enter to load the bin, and by which the a front loading truck may obtain access to remove and empty the bin. Alternatively, the restaurant may have a rear garage. The garage may have a main door by which the removal truck gains access to the bin, and a pedestrian or back door that communicates internally with the restaurant, and by which employees may load the bin without going outside. The use of waste compactor devices tends to increase the size of waste collection bins such that they will no longer fit in existing bin enclosures. Also, it is often difficult to access the back side loading openings of existing compactor devices.

SUMMARY OF INVENTION

In an aspect of the invention there is a waste containment apparatus. It includes an enclosure and a compactor including a motor and a compaction compression head driven by the motor. The enclosure has external lifting fittings and the compactor is mounted within the enclosure. The enclosure defining a storage accommodation for compacted waste and the compactor is operable to compact waste introduced into the enclosure.

In a feature of that aspect of the invention the external lifting fittings are guides for a pair of forks of a garbage truck and the guides are mounted on opposed sides of the enclosure. In another feature the enclosure has a bottom wall, a front wall, a back wall, a first side wall, a second side wall, and a top wall. The front wall, back wall, first side wall and second side wall are arranged about the bottom wall and stand upwardly therefrom to define an open topped box. The back wall has an upper margin and the top wall is hingedly mounted along the upper margin of the back wall. The top wall is movable between open and closed positions to govern egress of waste from the enclosure and the external lifting fittings include a first fitting mounted to the first side wall, and a second lifting fitting mounted to the second side wall.

In a further feature the back wall is free of refuse entryways. In still another feature the enclosure has a refuse entryway defined in one of (a) the front wall; (b) the first side wall; and (c) the second side wall. In yet another feature the enclosure has a refuse entryway defined in the front wall. In another feature the apparatus has a refuse flow path. The flow path includes an entrance at which refuse is placed within the enclosure, a compaction zone in which refuse introduced at the entrance is acted upon by the compactor, and an accumulation zone toward which refuse is urged by action of the compactor.

In still yet another feature the compactor has a line of action in a first plane. The apparatus includes at least one obliquely mounted member oriented to urge refuse to move out of that plane. In a yet further feature the apparatus includes a releasable securement movable to an engaged position. When in the engaged position, the securement is operable to hold the top wall in a closed position.

In another feature there is a combination of the waste containment apparatus and a stationary housing therefore. The stationary housing having a boundary wall extending about a predominant portion of the waste containment apparatus and the peripheral wall having an access side at which a refuse removal truck may approach the waste containment apparatus. The back of the waste containment apparatus being placed adjacent to the boundary wall, access to the back wall of the waste containment apparatus being precluded thereby.

In another feature the motor is mounted asymmetrically within the enclosure. In a further feature, the compactor is mounted closer to the first end wall than to the second end wall. In another feature the apparatus includes at least one blade. The blade is located at the refuse entryway to rip incoming refuse. In an additional feature there is a plurality of blades within the refuse entryway. The blades include a first group of blades and a second group of blades. The first group of blades is mounted opposite the second set of blades within the refuse entryway. In still another additional feature, the blades have angled cutting surfaces. The angled cutting surfaces of the first and second groups of blades are oriented to permit flow of refuse in a first direction and to resist flow of refuse in a second, opposing direction.

In another aspect of the invention there is a waste containment apparatus. It has an enclosure structure. The enclosure structure has lifting apparatus for engagement by lifting forks of a garbage truck bin lifting apparatus. The enclosure has a top opening lid operable to open when the enclosure is lifted and tipped by the garbage truck bin lifting apparatus. A compaction apparatus is mounted within the enclosure structure. The compaction apparatus including a compaction ram. The containment apparatus having an input receptacle region. When the waste containment apparatus is sitting on the base, the compaction apparatus is mounted higher than the input receptacle region.

In another feature of that aspect of the invention, the compaction ram includes a pivoting ram plate, and the input receptacle region defines an arcuate chamber swept by the pivoting ram plate during operation thereof. In a further feature, the enclosure structure has internal wall members shaped to urge refuse to follow a flow path to fill the containment apparatus. In another feature, one of the wall members is arcuately curved to deflect refuse from an horizontal flow direction to a predominantly upward flow direction. In a further feature, one of the wall members is slanted cross-wise to flow of refuse to urge the flow to an out-of-plane direction to fill a side-ways adjacent portion of the enclosure. In still another feature, the containment apparatus enclosure has a front side and a rear side; and both the lifting apparatus and the input receptacle region have front side access. In yet another feature, the containment apparatus has a front side, a rear side, a left hand side, and a right hand side, and the compaction apparatus is mounted eccentrically left to right. In still yet another feature, the apparatus has knives mounted therein, and the compaction apparatus is operable to drive waste placed therein past the knives.

BRIEF DESCRIPTION OF THE ILLUSTRATIONS

The invention may be explained with the aid of the accompanying illustrations, in which:

FIG. 1*a* is a general arrangement isometric view taken from in front, above and to the left side of an embodiment of a waste containment apparatus according to an aspect of the present invention;

FIG. 1*b* shows the waste containment apparatus of FIG. 1*a* with its waste receiving input chute door open to receive a charge of refuse;

FIG. 2*a* is a front view of the waste containment apparatus of FIG. 1 with the door closed and with a continuous lower front wall;

FIG. 2*b* shows a front view of the waste containment apparatus of FIG. 2*a* with the door open and a front wall with a lower cut-out;

Figure 1A:
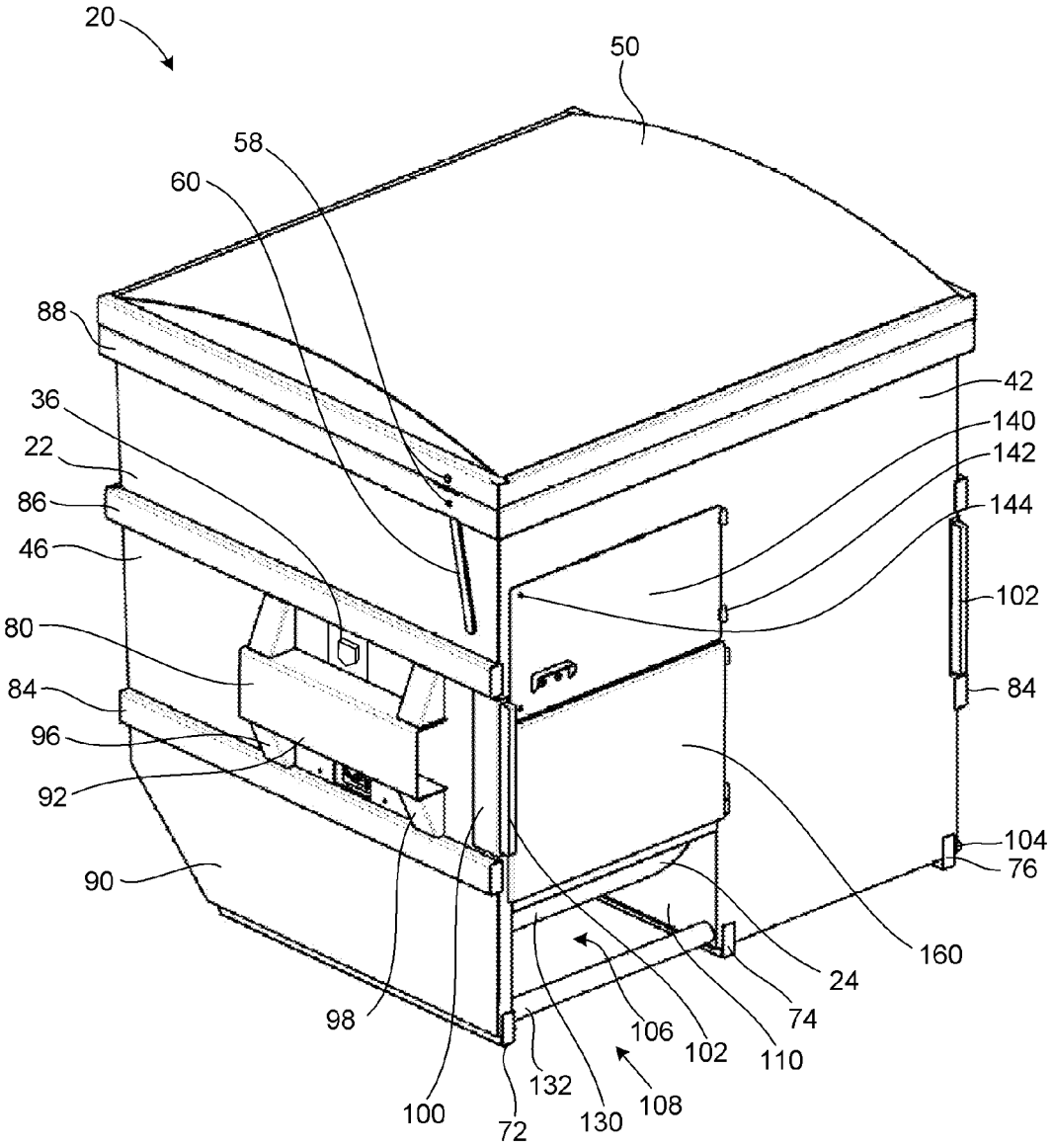
Figure 1B:
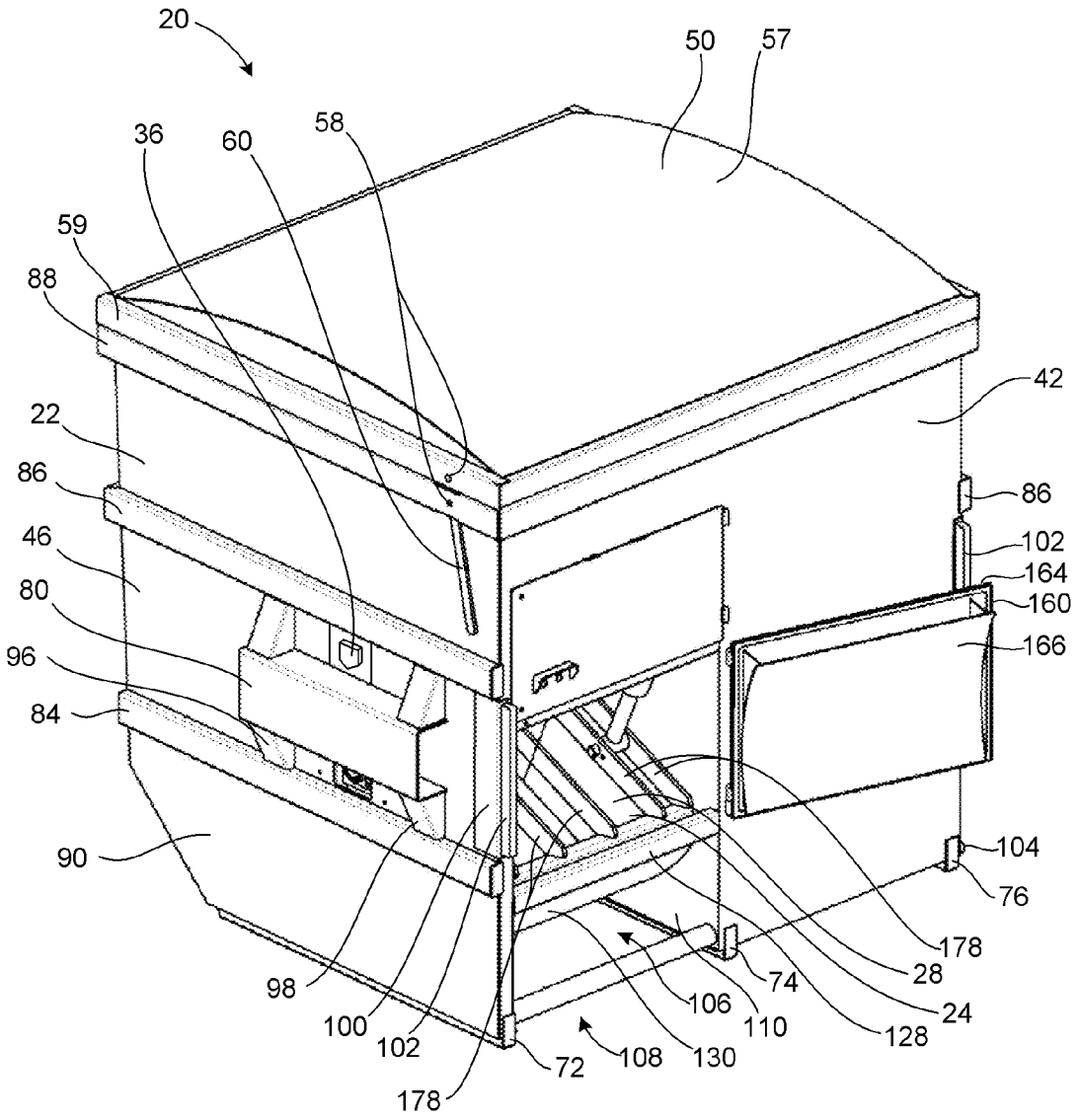
Figure 9B:
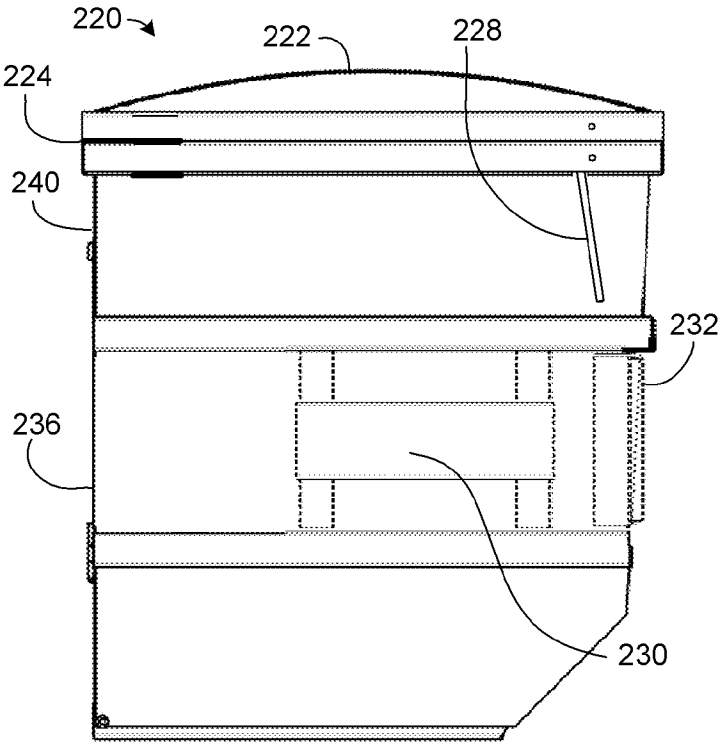
Figure 9A:
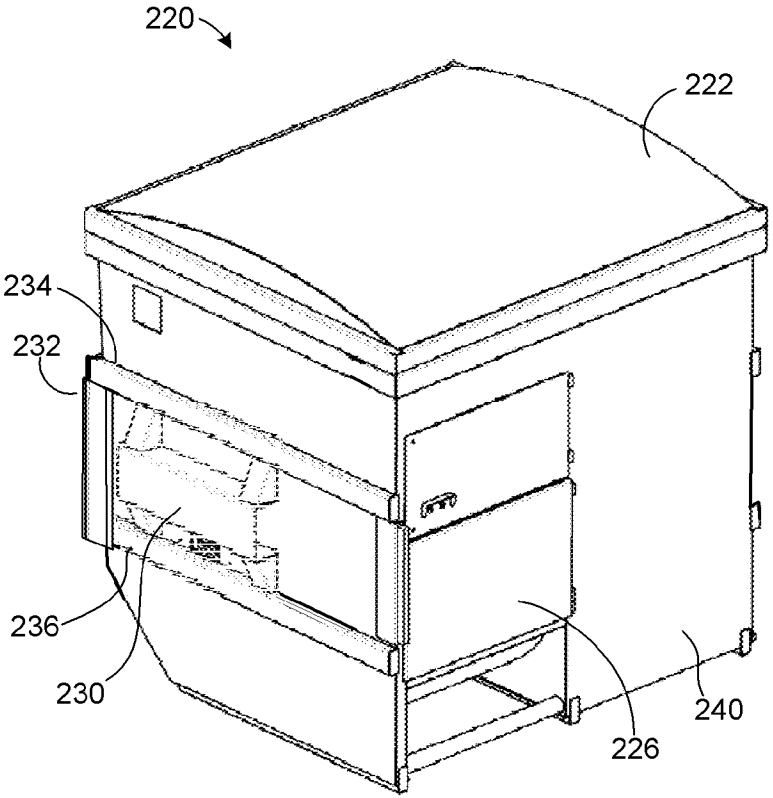

FIG. 9*a* is an isometric view of an alternate embodiment of waste containment apparatus to that of FIG. 1*a* with a reversed hinge arrangement;

FIG. 9*b* is a side view of the apparatus of FIG. 9*a*, as viewed from the side face not visible in FIG. 9*a;*

Figure 10D:
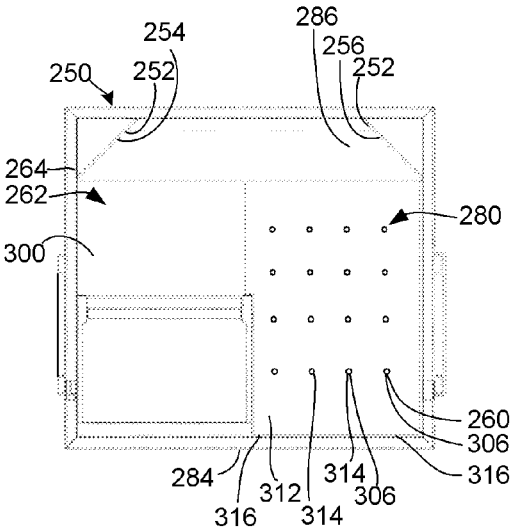
Figure 10A:
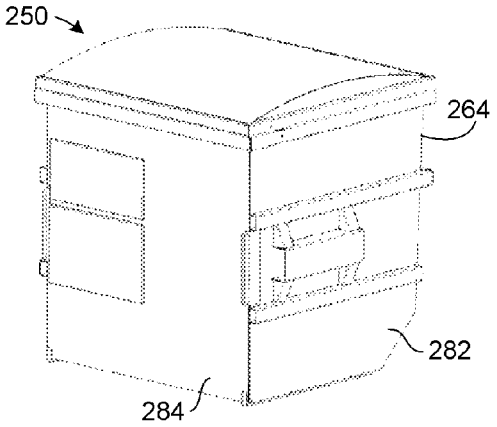

FIG. 10*a* is a perspective view of an alternate embodiment of waste containment apparatus to that of FIG. 1*a;*

Figure 10C:
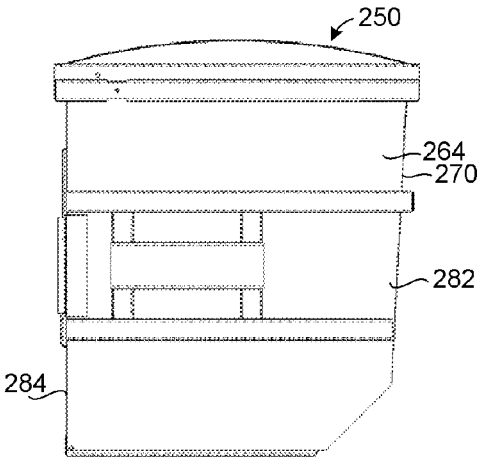
Figure 10B:
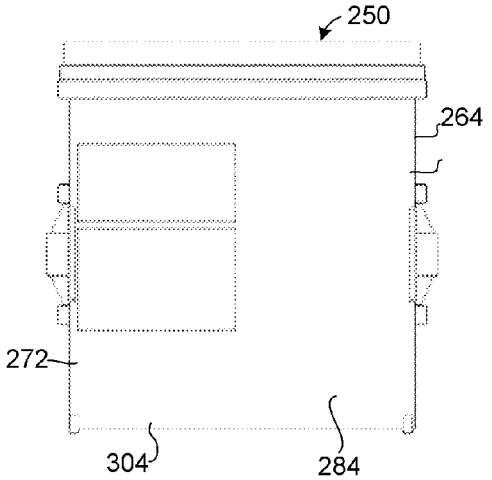

FIG. 10*b* is a front view of the waste containment apparatus of FIG. 10*a;*

FIG. 10*c* is a side view of the waste containment apparatus of FIG. 10*a;*

Figure 11A:
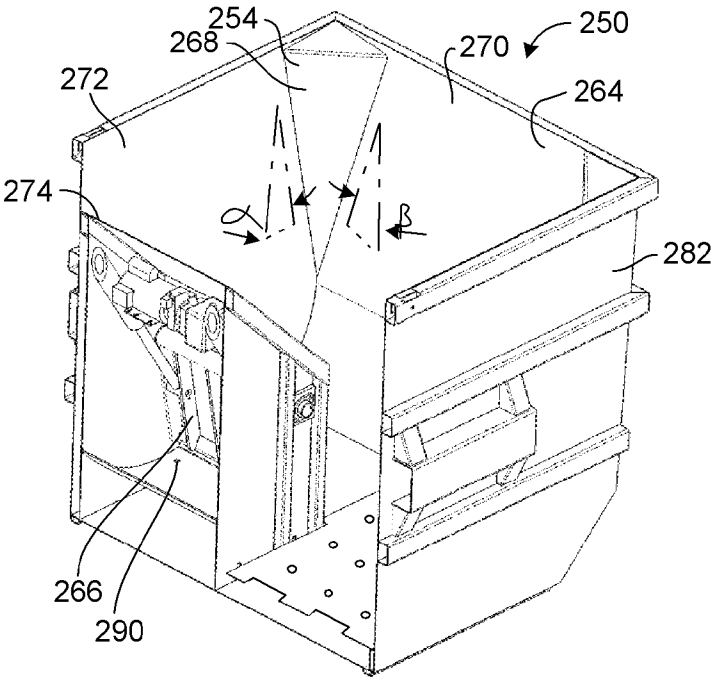
Figure 11B:
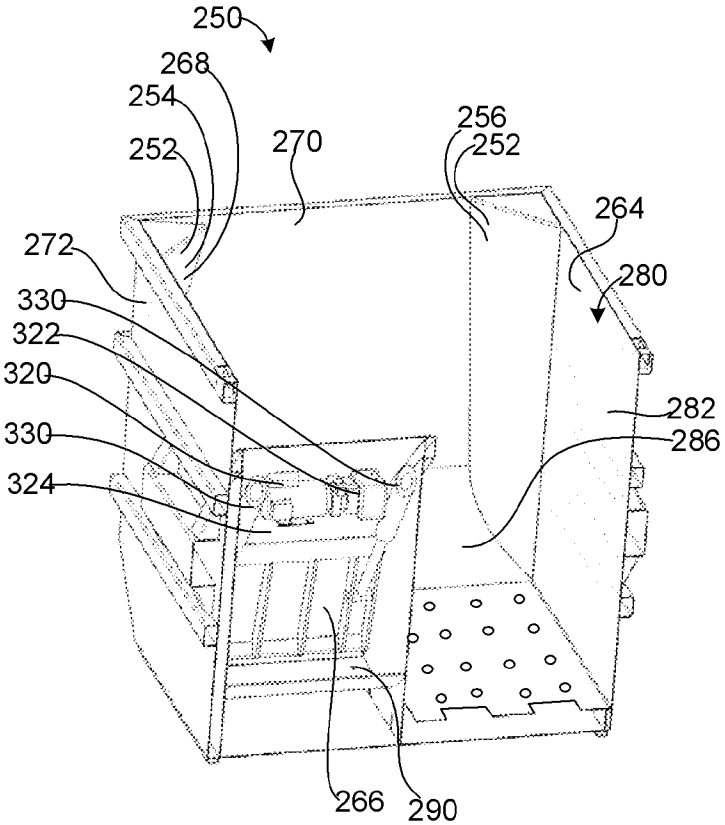
Figure 12A:
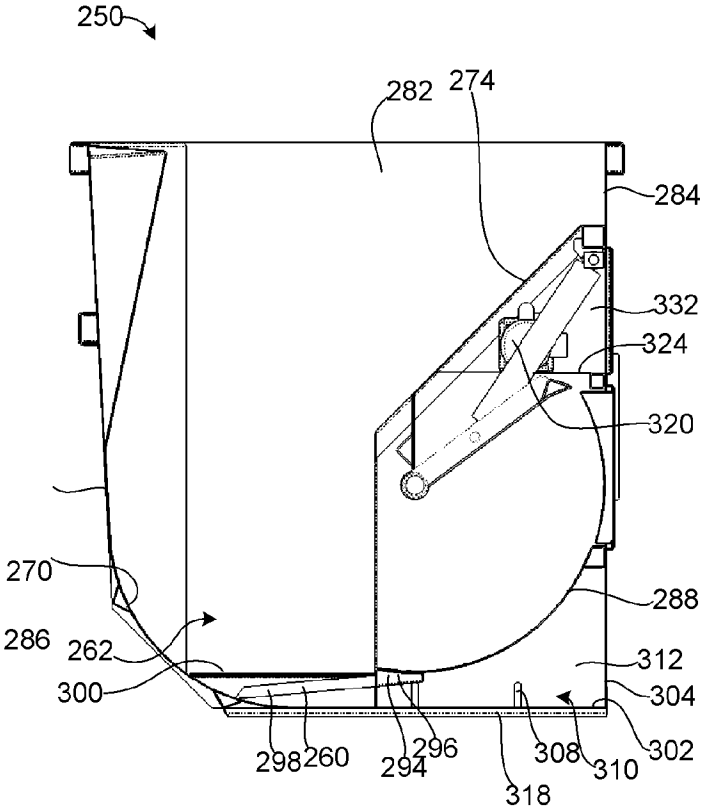
Figure 12B:
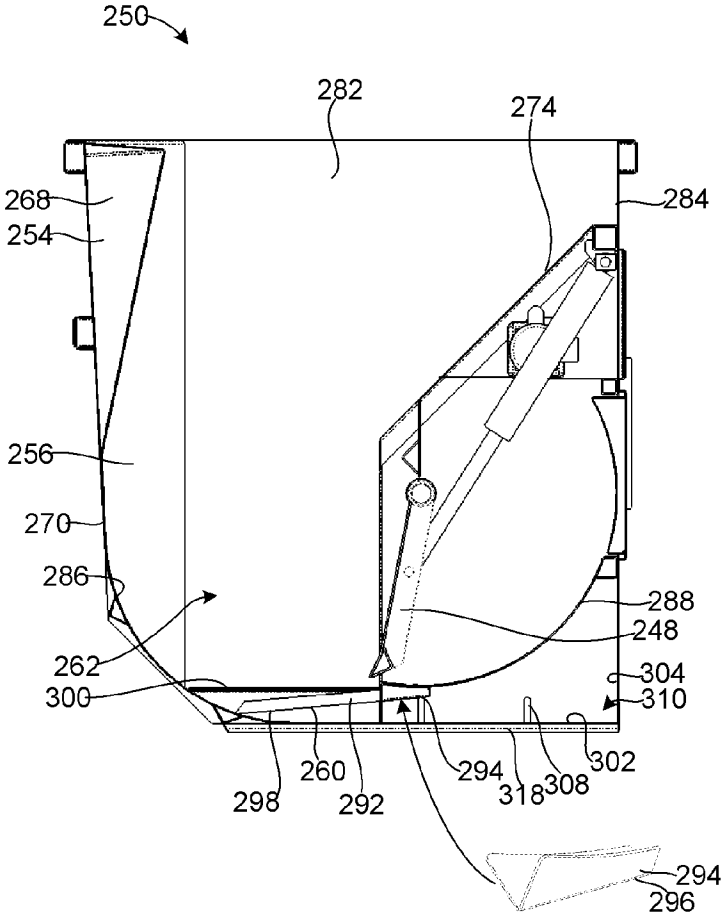

FIG. 10*d* is a top view of the waste containment apparatus of FIG. 10*a* as seen with the lid removed;

FIG. 11*a* is an angled view of the apparatus of FIG. 10*a* with the front wall and top removed to reveal an internal deflection wall;

FIG. 11*b* is another angled view of the apparatus of FIG. 10*a* with the front wall and top removed to reveal a second internal deflection wall;

FIG. 12*a* is a sectioned side view of the apparatus of FIG. 10*a* showing the compaction apparatus in its retracted position; and FIG. 12*b* is a sectioned side view of the apparatus of FIG. 10*a* showing the compaction apparatus in an advanced position.

DETAILED DESCRIPTION

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated, to more clearly to depict certain features of the invention.

The inventor seeks a fair and reasonable interpretation of the claims, and of this specification. The terminology used in this specification is thought to be consistent with the customary and ordinary meanings of those terms as they would be understood by a person of ordinary skill in the art in North America. Following from the decision of the Court of Appeal for the Federal Circuit in *Phillips v. AWH Corp.*, the Applicant expressly excludes all interpretations that are inconsistent with this specification, and, in particular, expressly excludes any interpretation of the claims or the language used in this specification such as may be made in the USPTO, or in any other Patent Office, unless in some way supported by the specification or by objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of experience in the art.

Referring to the general arrangement illustrations of FIGS. 1*a*-7, a waste containment apparatus 20 may include members defining an enclosure 22. A compaction unit, or compactor, 24, is mounted within enclosure 22. Compactor 24 is self-contained. It includes a motor, 26 which may typically be an electric motor, and a compactor head, which may be a pressure plate or ram plate 28, such as may be driven in an actuating (and, conversely, retraction) direction by one or more actuator cylinders 32, 34, which may be hydraulic cylinders. To the extent that an external connection is required, there may be an electrical or compressed air power connection mounted to the external wall structure, as at 36 on one of the side walls sheltered between the side wall stiffeners and gussets. The unit may tend to be free of external hydraulic connections, or other connections such as might be prone to drip of leak oils or greases, or other toxic or corrosive, or otherwise dangerous or environmentally undesirable liquids.

The apparatus may include a first major assembly, being the enclosure wall structure 22 generally; and a second major structure, or component, or assembly, being the compaction module or compact 24. Unless otherwise noted, it may be understood that this is a sheet steel structure of all welded construction. Although other materials, such as aluminum, stainless steel, or an engineered composite, might possibly be used for some specific purposes, garbage containers of this nature may tend to be exposed to relatively abusive handling, and for such service a mild steel construction may be most appropriate.

Enclosure 22 includes a bottom wall 40, a front wall 42, a rear or back wall 44, a first or left hand side wall 46, a second or right hand side wall 48, and a top wall 50. In the embodiment illustrated top wall 50 is a lid, or cover. Front wall 42, back wall 44, and left and right hand end walls 46 and 48 co-operate to define a peripherally extending wall that stands upwardly from bottom wall 40, the structure having the form, generally, of an open topped box. The upper margins of front wall 42, back wall 44, first end wall 46 and second end wall 48 co-operate to define an opening, indicated generally as 52, which, defines, is the exit or outflow opening of enclosure 22 more generally. The height of enclosure 22 to the margin or rim at 52 is identified as $h_{22}$.

The rear margin of top wall 50 is hingedly mounted to the upper margin of back wall 44 as at 55. Top wall 50 is thus pivotally movable back and forth in the direction of arrow "A" between a first, or closed position, as shown, and a second, or open position when the bin is being dumped. As such top wall 50 defines a closure member mounted athwart the exit 52 of the enclosed space 54, and governs egress of material (i.e, refuse) therefrom. Top panel 50 is provided with dogs, or hard eyes, or securement lugs 56, which are engaged by the mating lugs, or hooks of a hold down whose actuating lever 60 is located external to first end wall 46. When lever 60 is moved lugs 56 engage and secure the lid in the closed position. Given that compaction of refuse is to occur within the enclosure, top wall 50 may be of fairly substantial construction and may include a cylindrically arcuate retaining sheet 57 surrounded by a peripherally extending reinforcement frame 59 as shown. There may be a bulb seal between the main lid and the body of the bin, such as may tend to prevent undue insect infiltration. A screened vent 61, e.g., in the end face of top wall 50, may aid in prevention of undue build up of gases, and may ease or permit escape of air during compaction. The juncture between bottom wall 40 and back wall 46 may be on an arcuate sheet 62, the arcuate sheet being reinforced by lateral braces, or stiffeners 64, 66, which may have the form of steel angle irons welded with toes-in against the curved sheet. Further lateral stiffeners 68 and 70, which may have the form of channels welded toes-inward or the form of hollow steel tubes, reinforce back wall 46 at an intermediate height and along its uppermost margin respectively. Fore-and-aft skids 72, 74, 76 extends under bottom wall 40, and perform, not surprisingly perhaps, as skids upon which the unit rests. These skids may be roughly 1½" (40 mm) high to provide a standoff sufficient to permit a fork lift to lift the entire unit from below.

Inasmuch as in normal operation apparatus 20 is emptied by a garbage truck with a pair of forks, enclosure 22 has left and right hand (or first and second) lifting members or fittings, or assemblies, indicated as 80, 82, which may be mounted to the first and second side walls, 46 and 48 respectively. It may be noted that the side walls 46, 48 may each have a pair of first and second fore-and-aft reinforcements or braces 84, 86, and an uppermost reinforcement 88 mounted along the uppermost margin of the side walls 46, 48. Braces 86, 88 may be located at the same height as reinforcement stiffeners 68 and 70 respectively. In each case, structural steel tubes or channels may be employed. Assemblies 80, 82 may include fore-and-aft oriented channels 92, 94 mounted toes in against the respective side walls 46, 48 intermediate braces 84 and 86. Channel sections may be trimmed to yield reinforcement gusset members 96, 98 on each side.

A side stand-off 100, which may have the form of a vertically extending flat bar welded along the front margin of the side sheet between braces 84, 86 is provided to tend to discourage damage of the side sheet assembly by the forks of the garbage truck. Similarly, a front stand-off 102, which may have the form of a further flat bar welded to the frontward face of stand-off 100 may provide a means by which to discourage or prevent the lifting apparatus of the engaging garbage truck from coming into contact with or otherwise damaging front wall 42. Enclosure 22 may include a drain plug 104 by which accumulated liquids may be drained from enclosure 22, and, on occasion, wash water may be drained. The drain may be, typically 1" dia., and may have a manual valve. Drain plugs may be located on either side of the unit.

Figure 2A:
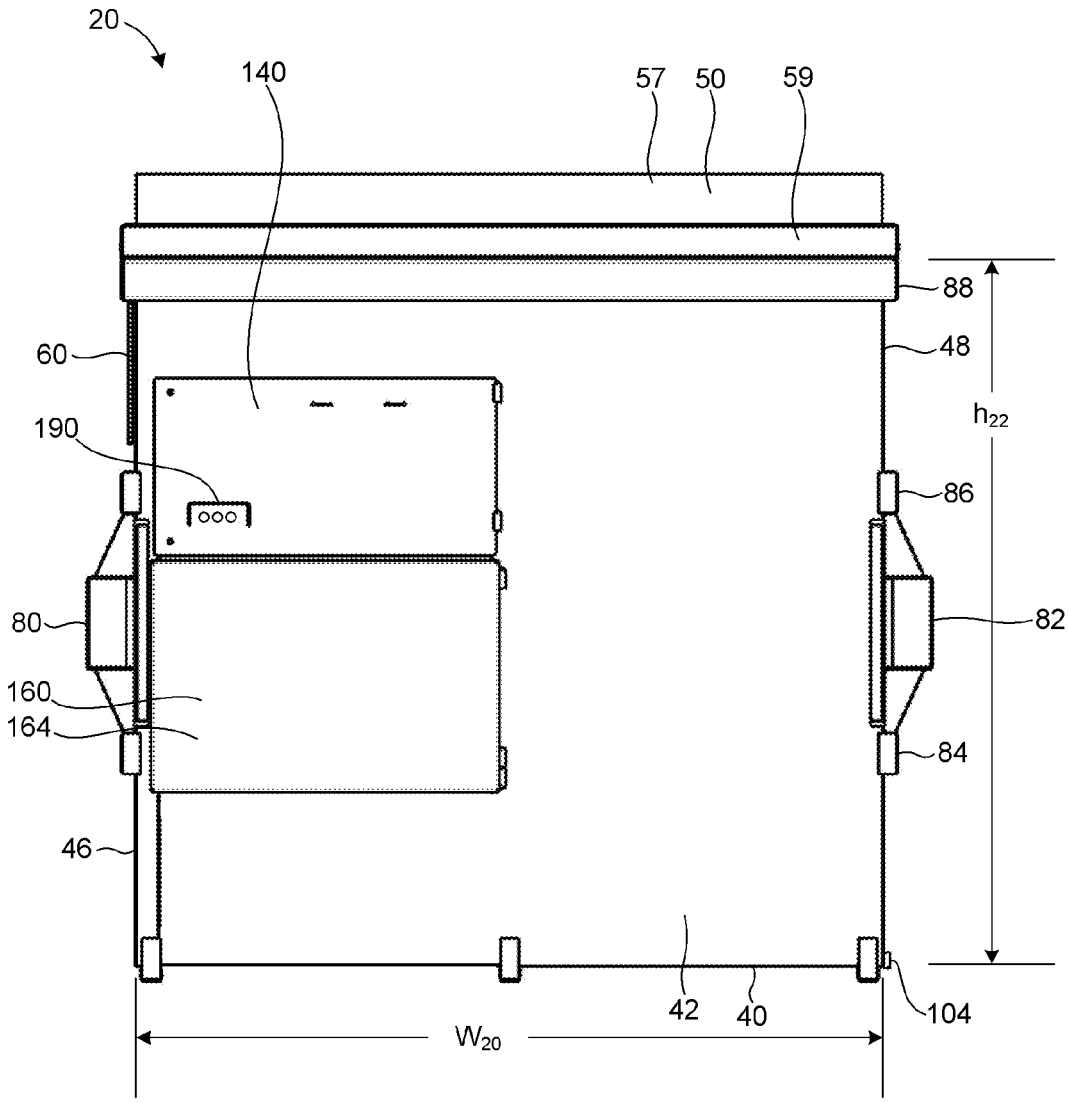
Figure 2B:
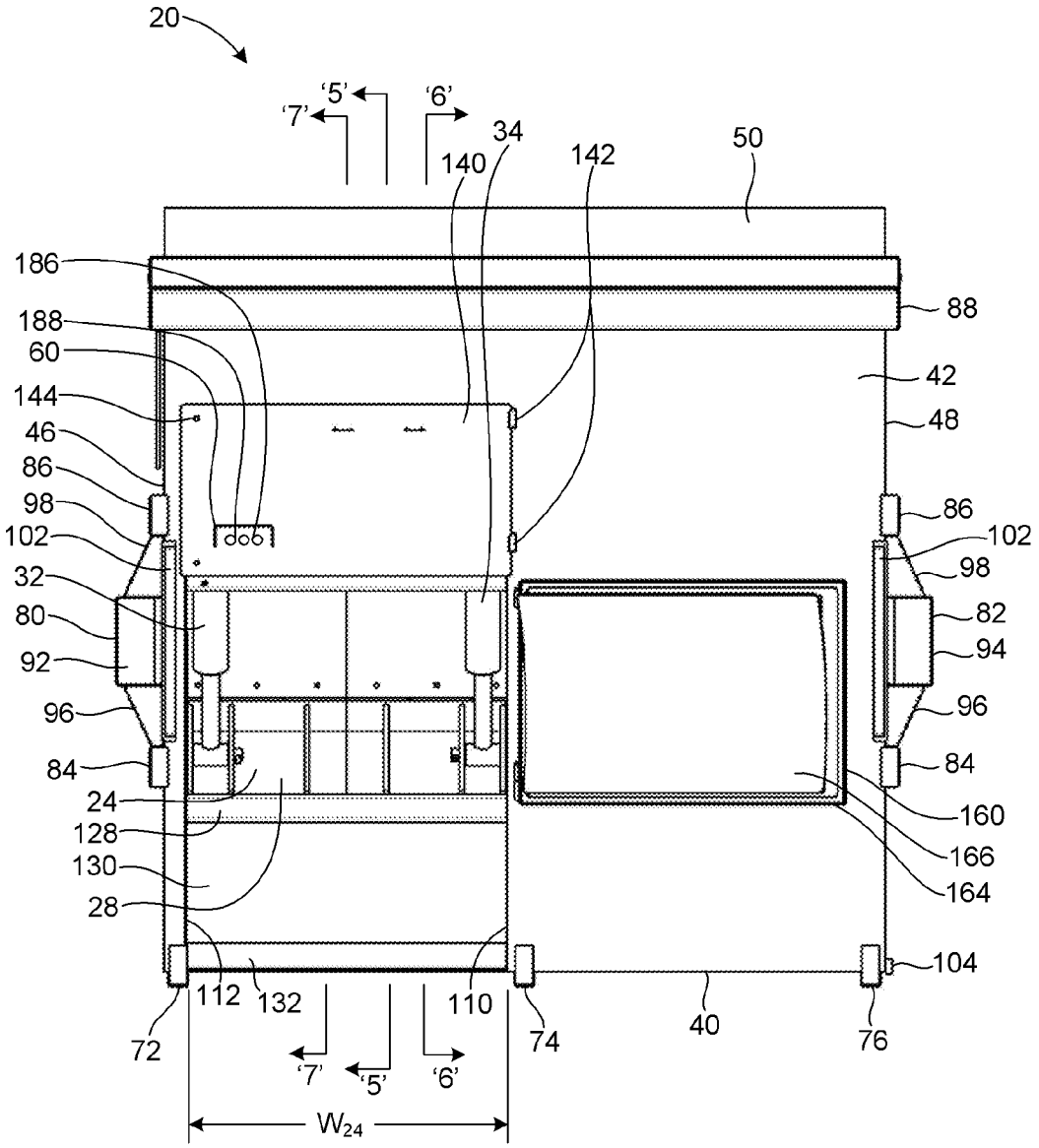
Figure 3:
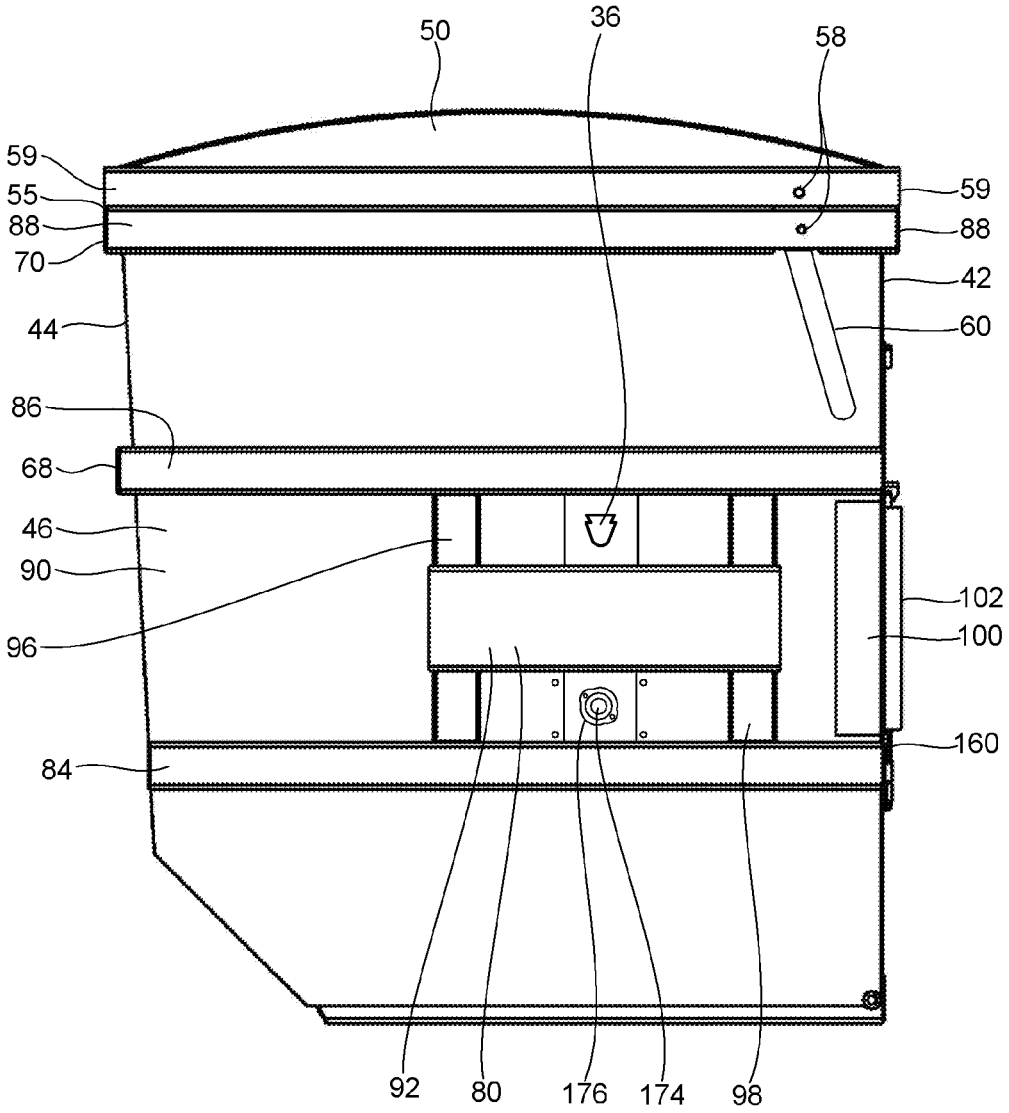
FIG. 3 is a left hand end view of the apparatus of FIG. 1*a;*
Figure 4:
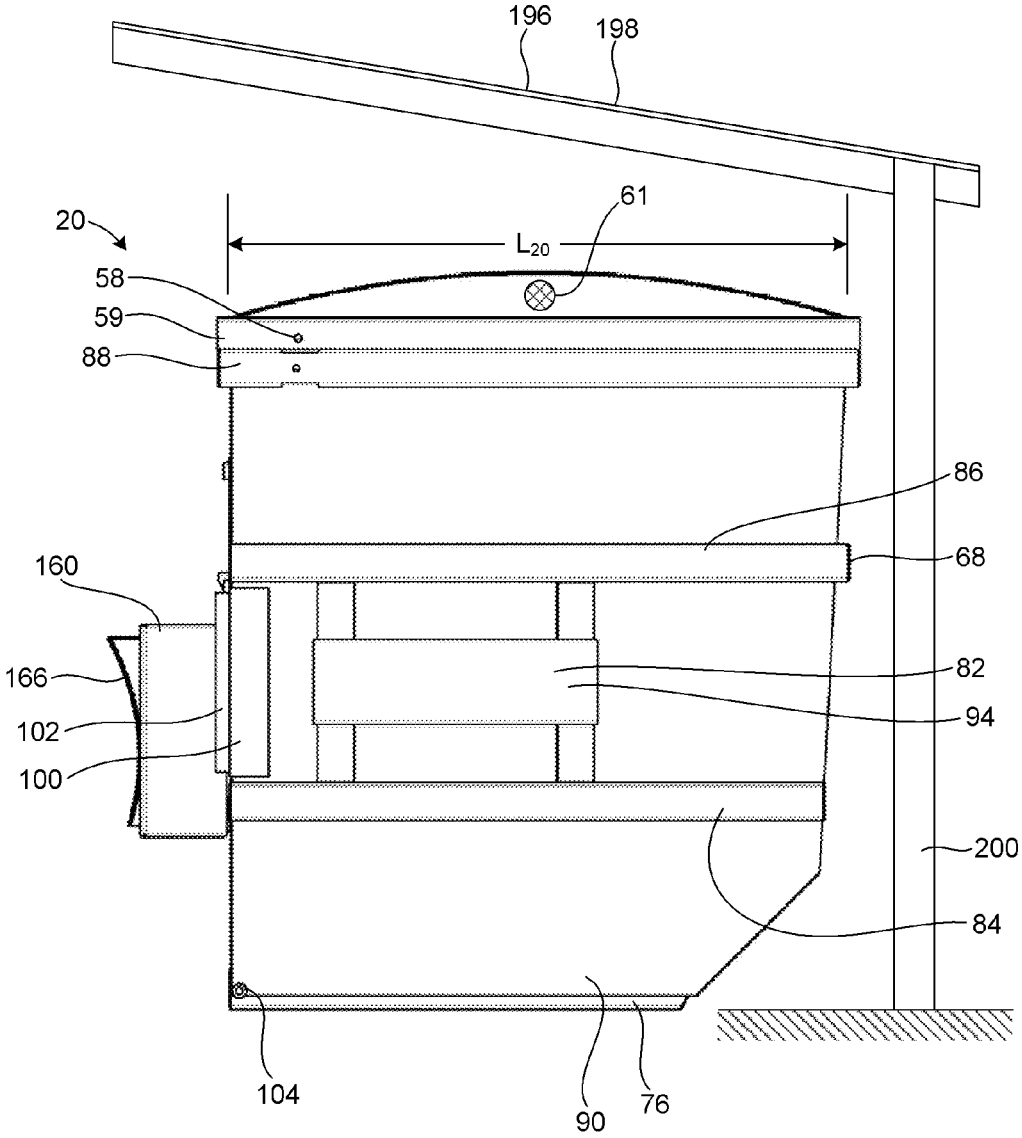
FIG. 4 is a right hand end view of the apparatus of FIG. 1*a* with the door open.
Figure 5:
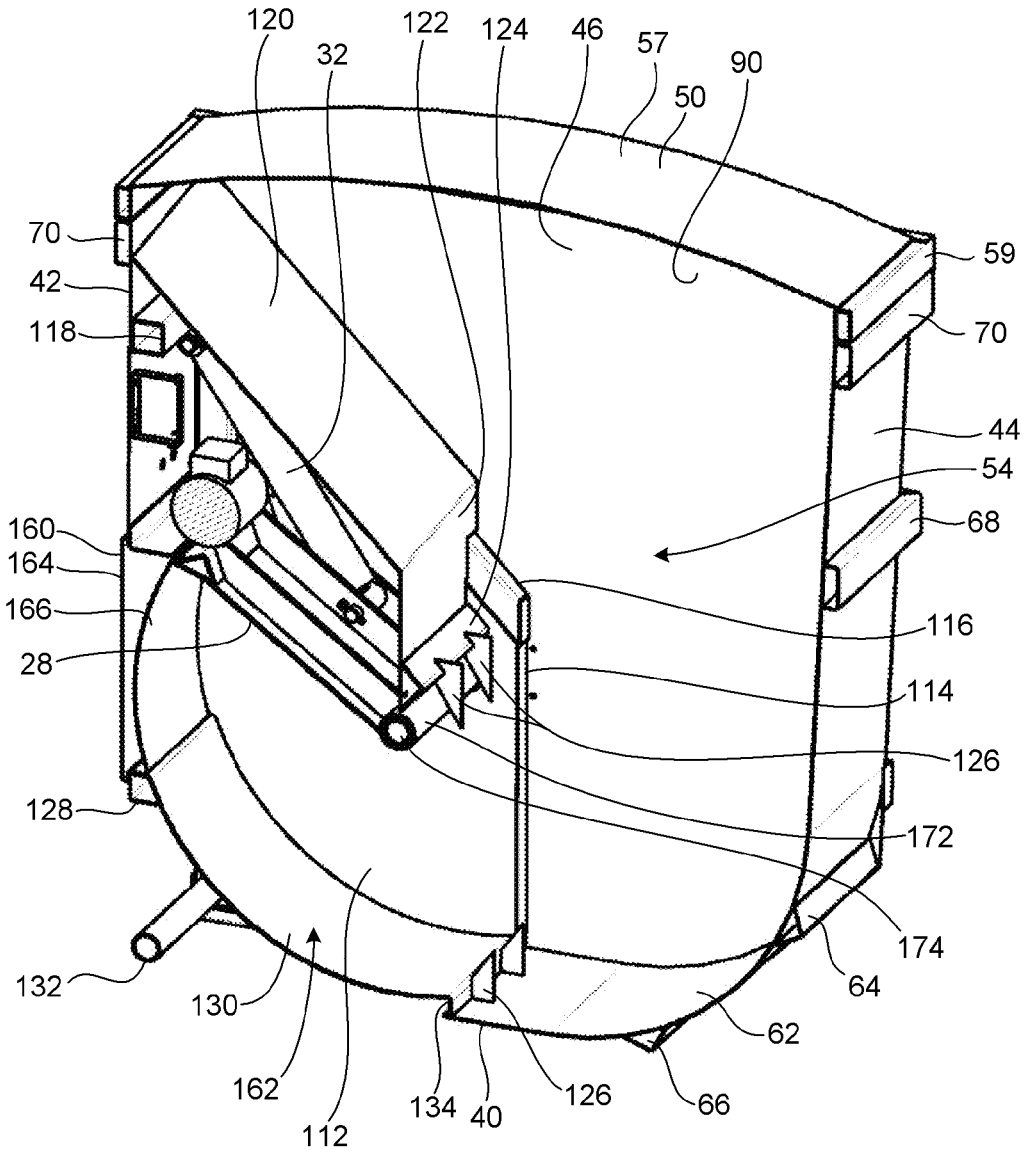
FIG. 5 is an isometric sectional view of the apparatus of FIG. 1*a*, taken at section '5-5' looking toward the left hand end of the unit.
Figure 6:
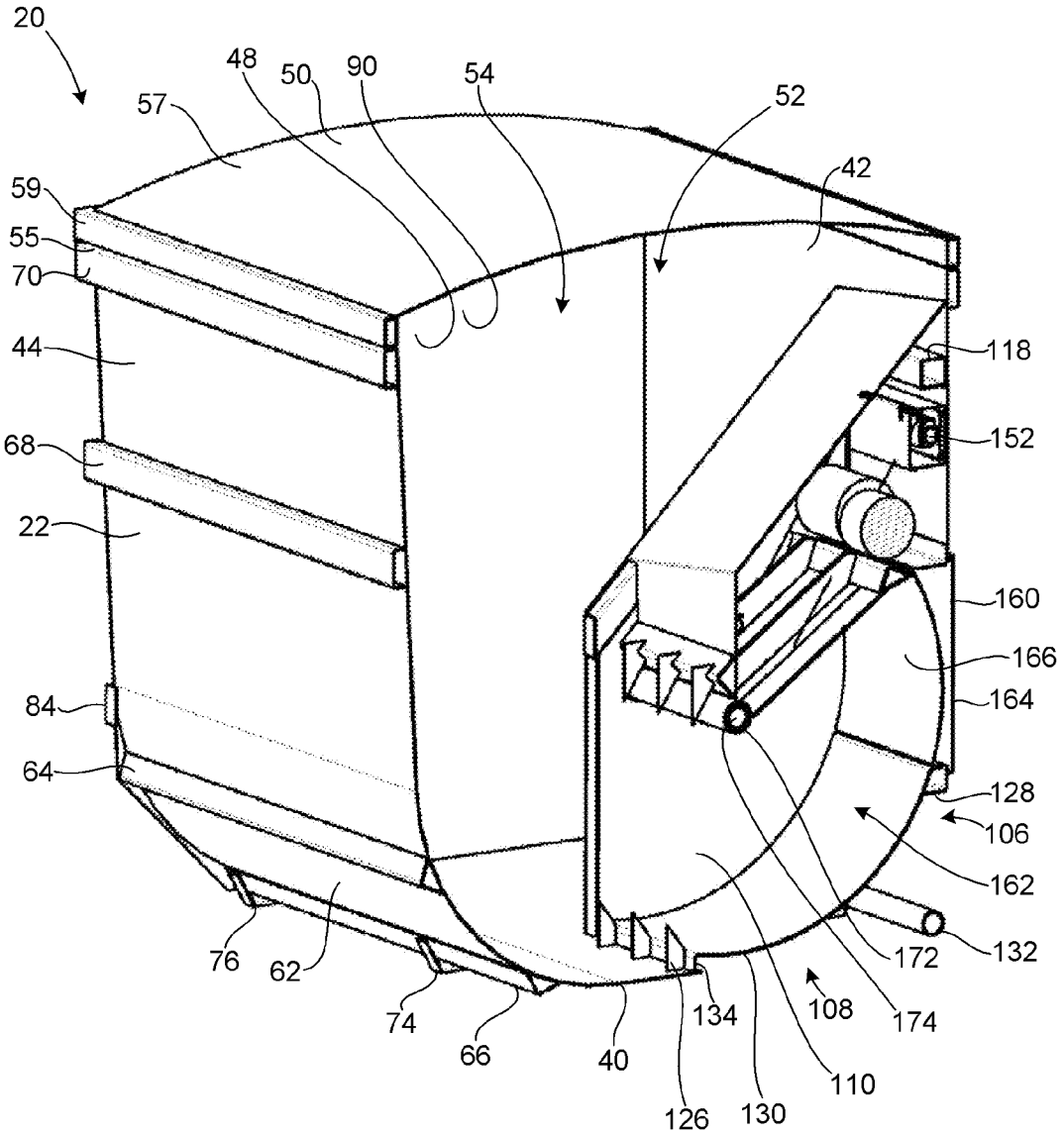
FIG. 6 is an isometric sectional view of the apparatus of FIG. 1*a* taken at section '6-6' looking toward the right hand end of the unit.
Figure 7:
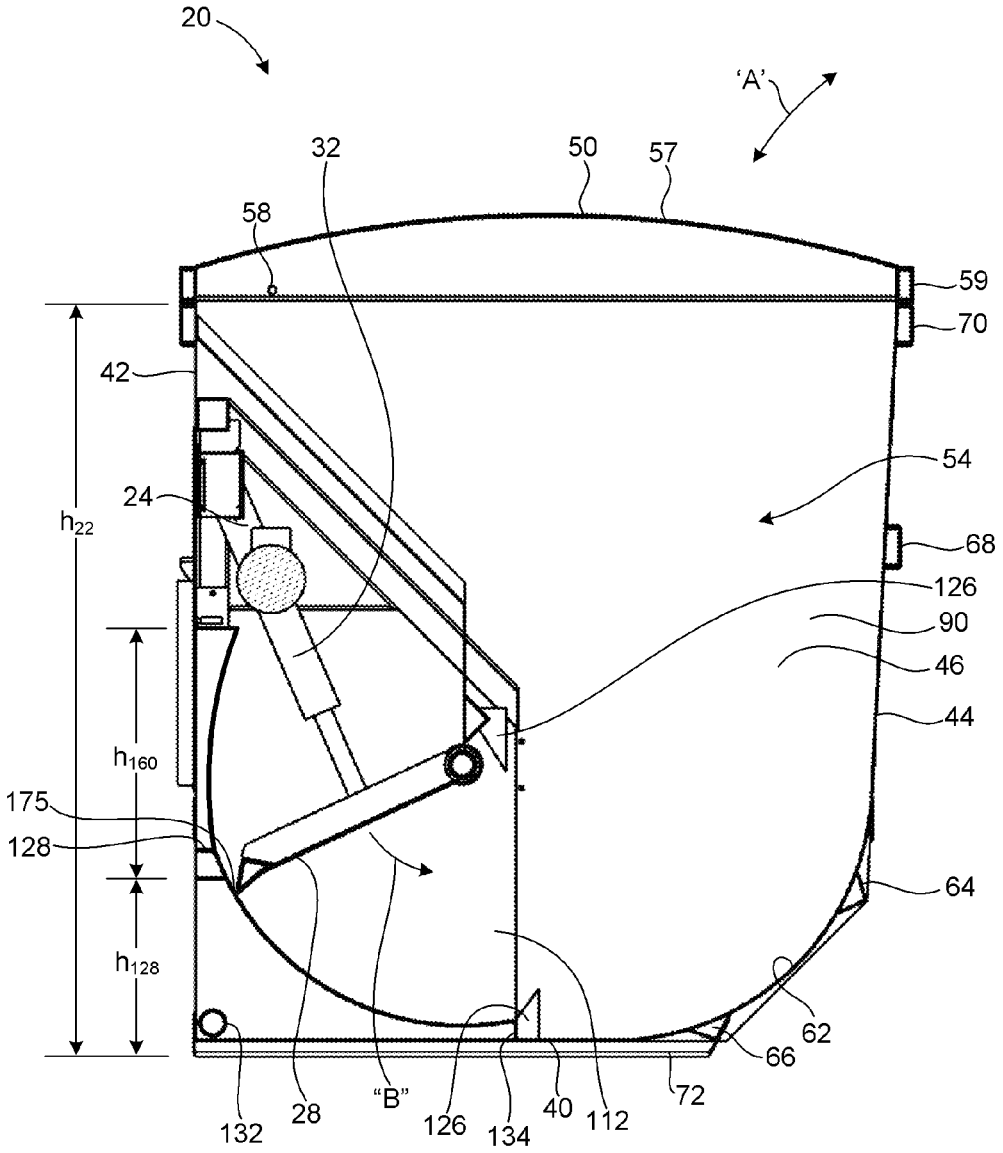
FIG. 7 is a sectional view of the waste containment apparatus of FIG. 3, taken on section '7-7' looking toward the left hand end, showing the compaction ram in a mid-travel position.

The second major module is the compaction module or compactor 24. Bottom wall 40 has a cut-out indicated generally as 108. This cut-out accommodates the installation of the compaction module as a pre-built unit, and also facilitate removal and replacement. The entranceway of the unit lines up with a cut-out in wall 42. This embodiment is illustrated in FIG. 2*a*. The module is lowered into the bin from above, then welded in place. Alternatively, the unit may also have a cut-out 106 formed in front wall 42, as shown in FIG. 1*a*. This cut out may be occupied by a cover plate in use, or may be omitted, as in the embodiment of FIG. 2*a*.

Compactor module 24 includes a pair of spaced apart, substantially planar, parallel sidewalls 110, 112 that extend in substantially vertical planes to define the side faces of the module. Wall 112 seats against first side wall 46 of the first side, and wall 110 defines an internal partition in a plane intermediate to, and substantially parallel to the planes defined by side walls 46, 48. It may be that the spacing of sidewalls 110, 112, indicated as $W_{24}$, is some portion of the total width of the unit. In the embodiment shown, that proportion may be taken as being half the lading width of the unit measured across the side sheets 90, more or less, and indicated as $W_{20}$. It need not be half. It could be some other proportion, such as ⅖, or ⅜, or ⅓, or, possibly even, ¼. The intermediate partition wall 110 may have the form of a trapezoid with a long leg located adjacent to front wall 42, and a short leg located inwardly of front wall 42, possibly in substantially the middle of the unit. The short vertical edge of the intermediate partition wall may then be reinforced by a vertical stiffener 114. A further stiffener 116 may run along the diagonally inclined upper edge of the trapezoid. A further lateral beam 118 may run laterally behind the cut-out margin of front wall 42.

Compaction module 24 may include an internal closure or cover plate 120. One may note that the upper diagonal edge of internal partition sheet 110 may be parallel to the upper edge of the outside sheet 112, and is at a lower height. Cover plate 120 is then inclined not merely in the fore-and-aft direction, but also has a lateral rake angle sideways. In use, then, refuse encountering cover plate 120 may tend to be encouraged to deflect toward the other portion of enclosure 22 not occupied by the compaction module. Cover plate 120 is welded between the upper margins of plates 110 and 112 and may tend to serve to prevent objects and unwanted liquids from falling onto the motor and ram. At the inboard, or lower, edge of cover plate 120 there is a vertical closure plate 122 that terminates along its lower edge adjacent the mounting of the pivot of the ram plate. The lower edge is reinforced by a welded angle iron 124. Optional blades, knives, fingers, gaffs, hooks, or tines 126 may be mounted to angle iron 124 as shown, with the sharp, pointy end facing downward, and the angled or chamfered face or edge toward the entranceway.

The bottom of the module is defined by a curved plate 130. The arc of plate 130 defines the outer or circumferentially extending boundary of a sweep-out. Plate 130 is a sector of a circular cylinder. It extends perpendicular to, and is welded to, plates 110, 112. A lateral reinforcement in the form of an inwardly turned channel 128 of uneven leg length runs along the upper margin of plate 130 between plates 110, and 112 (to which it is welded), and defines both an edge reinforcement of plate 130 and a lower sill of an entranceway door. The height of the lower sill of the doorway is shown as $h_{128}$. A further reinforcement, in the nature of a spacer tube 132 is welded between the lower front corners of plates 110, 112 to hold their planar spacing. The lower or inner, substantially horizontal tangent edge of plate 130 is bent to define a reinforcing flange 134. A channel, hollow structural section, or other reinforcement could also be used. Again, a set of blades, knives, fingers, gaffs, hooks, or tines 126 is mounted along this edge, with the sharp pointy end oriented upward, and the chamfered edge toward the entranceway.

The upper front cover plate 140 extends perpendicular to plates 110, 112, in a plane that is intended to be substantially flush with, or marginally offset from and abutting, front wall 42. This access plate is removable to facilitate servicing, to which end one may note hinges 142 at the staff edge, and bolted securements 144 in the distaff portion of the access door so formed.

A formed channel 146 extends perpendicular to, and is welded to plates 110, 112 and defines a motor mounting plate—the outer edge being formed into a flange or lip defining a land against which the door defined by plate 140 closes. A power pack that includes motor 26 is mounted above this plate. Motor 26 may be an electric motor that drives a hydraulic pump. The hydaulic pump, valves, and tank are located in the machinery zone above ram plate 28, and may be mounted on isolators, typically rubber isolators. The power pack mounting may be a cradle mounting that pivots with gravity when the bin is turned upside down, thus maintaining the power pack in an upright orientation. A diaphragm air breather will prevent the hydraulic oil from leaking when the unit is turned upside down. The hydraulic tank may be a steel tank or in warmer climates may be a plastic tank. The pump may be a two stage pump to hasten cycle times, (i.e., high flow and low pressure drop when resistance is low, higher pressure drop and lower flow when feedback from the ram indicates increased resistance to compression) or alternatively the two stage effect can be achieved using a three phase electric motor with frequency control to permit an increase or decrease in pump flow as may be appropriate. A motor control module 152 is mounted to the inside face of plate 140, and controls the operation of motor 26. Module 152 may be sealed to prevent contamination.

An entranceway door 160 is mounted to front wall 42 as shown, with its hinged on the intermediate edge. To the extent that the intermediate edge is less than or equal to the half width of apparatus 20 more generally, this door may be opened substantially 180 degrees (or close thereto), without the distal edge of the door ever protruding laterally beyond either first or second end walls 46, 48. Thus the door can not stick out and obstruct passage to either side of the unit, or foul objects when lifted. Door 160 is movable between a first, closed position as indicated, and a second, open position, and thus governs access to the entranceway or entrance accommodation or space 162 into which refuse may be placed prior to compaction. Door 160 itself may include a face plate 164, and an internal sweep plate 166 that is a cylindrical section. When door 160 is closed, sweep plate 166 co-operates with plate 130, being of the same radius and center of curvature. The height of the opening, i.e., the clearance dimension between the sill and the lintel for introducing the garbage, is indicated as $h_{160}$. This height may be approximately 22-24 inches. The lintel of door 160 may include an overhang, or rain drip shedding member to discourage the draining of water into the door. In an alternate embodiment, the single door may be replaced by a double door.

A ram plate is indicated as 28. Ram plate 28 may have a first edge welded to a circular tube 172, which in turn seats on a shaft 174 that passes from a trunnion seat in plate 110, through a trunnion seat in plate 112 and which is accessible for maintenance and servicing through a removal port 176 in first wall 46. Ram plate 28 has a distal edge that is reinforced by an angle iron, and may have a rubber sweeper or wiper 175 mounted along the margin to sweep against plates 166 and 130 during motion about the axis of rotation defined by shaft 174. The face plate may be angled near its three moving edges, the better to scrape material from the sides and bottom of the chute as the ram moves through its cycle. Plate 28 also has an array of stiffeners or reinforcements in the nature of longitudinal members or ribs 178 spaced laterally thereacross to discourage bowing of plate 28. The outboard pairs of ribs 178 have bores formed in them to define sockets for the end pins of left and right hand hydraulic rams 32, 34. The opposite ends of those rams mount on pins anchored to lateral beam 118. Hydraulic power for extension and retraction of the rams is provided by motor 26, as controlled by motor control module 152. A further rubber wiper may be mounted between the cover plate extension and cylindrical tube 174 to discourage liquids and other contaminants from migrating into the hydraulic ram chamber above plate 28. External operation is controlled by an array of switches that includes an operating switch 186 and an emergency kill switch, 188 mounted in the lee of a protective shield 190 on the face of the unit. The switches may also include a keyed on/off switch to turn the unit on and off. The unit will include a light to indicate whether power is connected to the unit. The control circuitry will be mounted in control module 152 behind (or under) the panel that also covers the power pack unit and the cylinders. The electrical control box is watertight. Some or all components may have disconnect plugs to facilitate quick change out and replacement. The control box will also have a manual override switch permitting the ram plate to be operated while the control panel is open. The override will stop automatically if released by the operator. The power pack is located between the cylinders to permit relatively easy replacement by unplugging the power cord and removing the unit. The cylinder pins are accessible from the front of the unit after the access panel has been removed.

Figure 8:
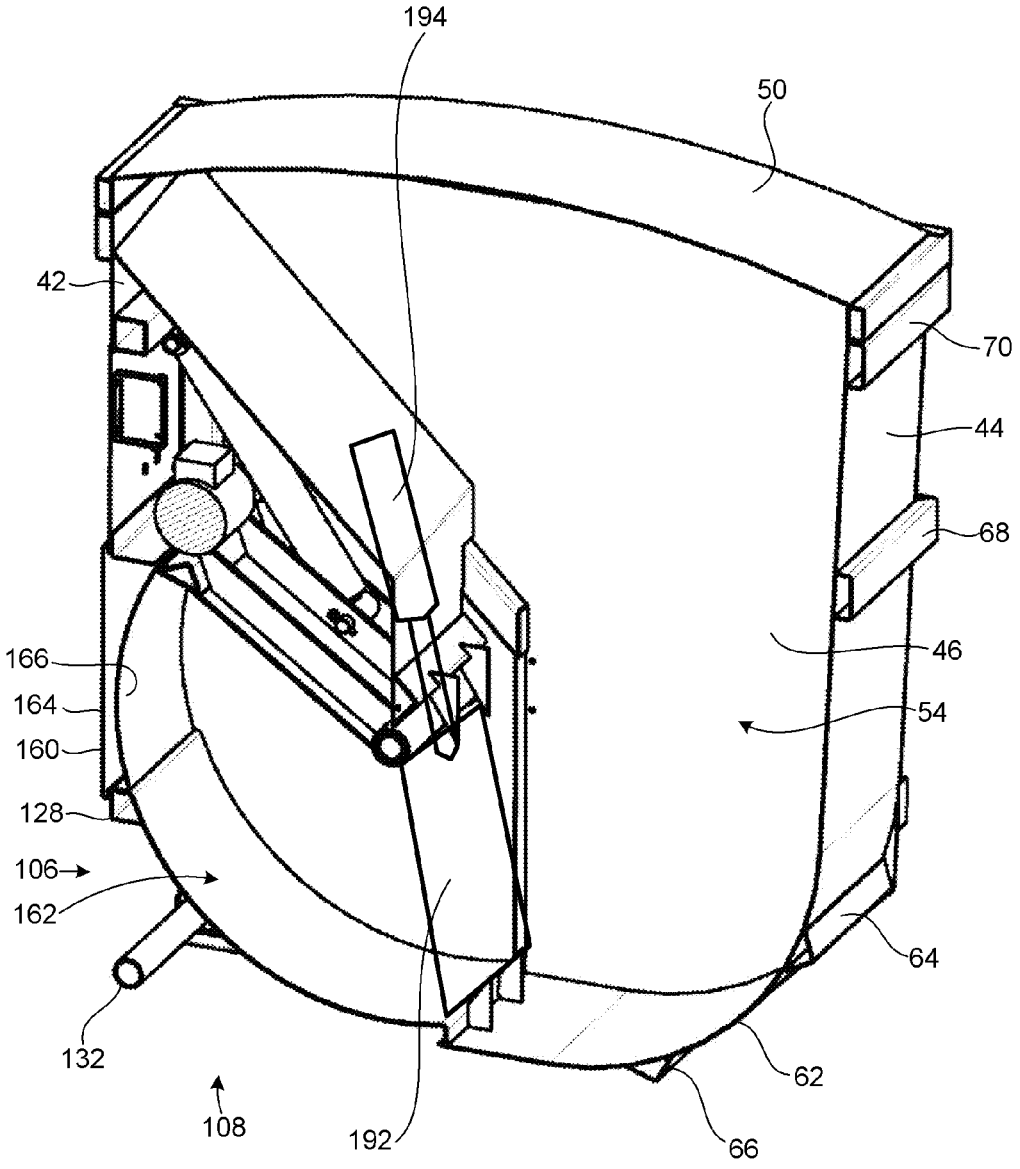
FIG. 8 is a sectional view, similar to FIG. 7, of another alternate embodiment of waste containment apparatus to that of FIG. 1*a;*

In the alternate embodiment of FIG. 8, the apparatus also included a vertically reciprocating gate, or ram scraper, or load holder, or retainer or retaining member, identified generically as gate 192, driven by an hydraulic ram 194. Hydraulic power is, as before, provided by motor 26 driving an hydraulic pump, under the control of electronic controller 152. In this case, when ram plate 28 is driven to full forward travel, reciprocating gate 192 is driven downward by ram 194. Gate 192 need not be driven fully downward to entirely obstruct the opening, but rather merely sufficiently far to prevent spring back of the already compacted refuse back into the inlet chute. To that end, gate 192 need not be a solid continuous panel, but could be something akin to a portcullis or pitch-fork, i.e., an array of bars or spikes such as may tend to engage the refuse and prevent rearward motion. Thus the device has, in effect, an impelling member, and a holding member, in effect, a pawl, and may be thought of as a kind of load retainer. It can also be thought of as a scraper that, in a sense, scrapes the garbage off the front of the ram plate. Further, it may be thought of as a load reliever, since it then take pressure off the face of ram plate 28. It may be understood that while a pivoting ram plate is shown and described, a linearly reciprocating plate could also be employed.

In each of the embodiments described herein, the compactor module includes a compactor and a frame for supporting or holding the compactor. The compactor includes a motor, a drive train, and an output ram or head. For example, motor 26 is connected to the hydraulic pump, which drives the hydraulic cylinders, i.e., rams 32, 34, which drive plate 28. Although the compactor could be mounted centrally, it is mounted eccentrically, or asymmetrically to one side of the central vertical plane, being closer to one sidewall of the unit, 46, than to the other sidewall, 48.

A typical use of this unit is for loading and pre-compacting refuse from a fast food restaurant. In that context, suppose that a load of refuse is brought to the unit. The refuse may typically arrive in plastic garbage bags. The loader wishes to load the unit. To that end, assuming the electrical (or pneumatic) power connection has been made, he (or she) presses the green operation button. This causes power to be applied to the hydraulic cylinder, causing them to retract and to move ram plate 28 to its raised position above and clear of the door. Once stopped and locked in the raised position, the door solenoid is energized to permit door 160 to be opened. When the door is opened, the disengaged door switch means that a valve in the hydraulic circuit is, by default, closed, preventing the flow of hydraulic fluid and therefore resisting any change in ram position. Some refuse is introduced through the entranceway or entrance chute, or receptacle, defined by the door and into what amounts to the ante-chamber, or entrance space of the apparatus.

When the chute is filled with a suitable "charge" of garbage, the door is closed, and the operator again presses, and holds, the green button (alternatively, a third button could be provided). The electronic controller verifies that the door is closed, i.e., by polling the solenoid switch. Further, and optionally, a weight sensor confirms that the charge of garbage is less than a threshold value, which may be about 50 pounds. If so, the door solenoid is energized to lock the door closed again (If not, a fault alarm may be set, motor operation is inhibited by locking the motor out, and the door solenoid de-energized to a position in which the door cannot be locked closed.) Alternatively, in a different embodiment, the operator holds (i.e., presses) the green button for a period of time, such as three seconds, which may cause the ram to move to a retracted position. The door can then be opened, and loading of the unit may take place. When the door is closed, it may then lock and activate automatically on closing of the door. Power is inhibited to motor 26 unless the door is locked by the door solenoid. When a confirming locked signal is obtained, the ram plate solenoid is unlocked to permit ram plate 28 to advance. Power is applied to the hydraulic cylinders for this purpose. The attentive reader will have noted that the door open position shown in FIGS. 1*b* and 2*b* could not actually occur in normal service because the door solenoid would not yield the required closed and locked signal, so the ram plate could not move out of its at rest, or "parked" position to the mid-range position shown in those illustrations. However, the drawings are provided to show internal geometry, as opposed to an actual normal operating condition.

The hydraulic cylinders drive the garbage into the enclosure space more generally, and, in so doing, may tend to drive the plastic garbage bags across one or more of the upper or lower knives 126. These knives are intended to rip the bags, such that when compression occurs, air is not necessarily trapped in the bag, but may rather tend to be able to escape. That is, the knives may tend to break the seal of the bags by puncturing them. This may tend to increase the effective capacity of the bin, as it may otherwise be more difficult to compress two or more layers of bags filled with air. Since enclosure 22 is not air tight, air squeezed out of the garbage bags can escape as required. As the bags are pushed past the knives, the orientation of the knives is such as to discourage springback or return of the bags toward the inlet. They may then tend to act as a kind of check valve or diode in the sense of permitting flow in one direction (i.e., inward) and inhibiting flow in the other direction. The ram cycles to full travel, stops, and locks. The operator then repeats the process until there is no more garbage to load.

Expressed from the view of the operator, operation commences when the operator presses a button on the face of the unit. The operator has no need of opening (and then closing) a large, heavy, cumbersome lid to heave bags over the top and into the bin. Pressing the button on the front of the unit causes the ram to retract to the position shown in FIGS. 5 and 6. Once the ram is retracted in this way, the solenoid latch of the door is automatically released. The operator opens the loading door and places a charge of garbage into the bin. The charge chamber opening is large enough to accommodate at least two 39"×46" or 35"×50" garbage bags, or the equivalent thereof. It will be appreciated that a smaller or larger compression chamber could also be used. The door is closed, which again activates a sensor. This is monitored, and causes the door solenoid to lock the door prior to actuation of the cylinders. The cylinders then extend to full travel, compacting the refuse in so doing. The ram plate remains in place in the full travel position until the unit is ready for loading again. By remaining the extended position, the ram plate provides a partition, or barrier or baffle. This wall or baffle may then tend, in effect, to seal the bin. The bin is dumped into the garbage truck with the ram in this position.

In the embodiment of FIG. 8, each time ram plate 28 advances in the direction of arrow "B" to full travel, gate 192, is subsequently driven downward to snag the charge, thereby preventing movement backward. If another charge is to be added, the retainer plate, gate 192, remains in place during retraction of ram plate 28. The door is opened by the operator, and another charge is placed in the intake chute. The door is closed and locked, and gate 192 is retracted (i.e., moved upward). Once gate 192 is secured in the upward position, ram plate 28 is advanced, sweeping out the entry chute, and driving the next charge across the knives. When ram plate 28 reaches the full forward travel position (in which it may be oriented substantially vertically, or parallel to gate 192), gate 192 is advanced once more to engage the charge and to prevent spring-back in the rearward direction. This process may be repeated until the bin (i.e., enclosure 22 more generally) is full.

In either case, the progressive action of ram plate may tend to drive the refuse back into the bin. It may then follow the curve of plate 62 and be directed upwardly. As it travels upwardly, it may tend, eventually, to be driven against the lid 50, or may tend to fall forward against slanted plate 120. This may urge the refuse to fall out-of-plane into the other side or portion of the bin, and to accumulate accordingly.

One way to sense the extent to which the bin is full is to monitor motor current. Should the motor exceed a certain threshold value, the unit may illuminate a "unit full" signal light. The unit may include a self-signaling unit that notifies either the restaurant operator or the garbage pick-up company that the bin is ready to be emptied. The unit may also include a partially full indicator, such as a ⅔, or ¾ or ⅘ full sensor or sensing threshold to act as a pre-warning, or anticipatory notice, to tell the operator or the garbage disposal company to schedule a pick-up in the next pick-up cycle.

One may note that the sill height, $h_{128}$, is relatively low, being less than one half, and, more so, in the embodiment illustrated, less than one third of the height $h_{22}$ of the unit from the ground. In absolute terms the sill height may be less than 36 inches, may be less than 30 inches, may be less than 24 inches, and in one embodiment is about 20 inches (50 cm.) above ground level. In some embodiments the sill height dimension, $h_{128}$, may be less than the door clearance dimension, $h_{160}$. This may be expressed differently, as a proportion of the height of the bin, $h_{22}$, more generally. $H_{128}$ may be less than ⅔ of $h_{22}$, and may in some embodiment be less than ⅓ of $h_{22}$. The physical significance of these ratios and proportions is that they tend to imply a relatively low lifting height for operators. With a sill height of 18-24 inches above the ground, the operator may tend to be able to use their legs and knees to aid in urging garbage bags over the sill. Where the height is at or above the waist height of the operator, loading such a unit may become a substantially more arduous chore relying more greatly on upper body strength. By comparison, the traditional bin loading method is to throw the garbage bags over the top of the rim, i.e., in excess of height $h_{22}$. This typically implies a loading height of 50 inches, if not quite a bit more, e.g., 66". Sometimes the thrower misses, or the bag breaks, or both. The use of a relatively low sill may tend to facilitate what might otherwise be a fairly strenuous task.

In normal operation, then, the spaced forks of the garbage truck slide into the awaiting tubes, or slides, defined between channels 92, 94 and side walls 46, 48 respectively. The truck operator disconnects the electrical connector from the external connector 36, and releases lever 60. The forks are then elevated, lifting apparatus 20 accordingly. When raised, the truck arms are tilted to invert apparatus 20, top wall 50 then falling open to permit the refuse to be discharged into the awaiting truck. The operator then lowers apparatus onto its skids 72, 74, 76, re-engages the lid latching lever 60, and reconnects the electrical (or pneumatic) power source connection, as may be, and proceeds to the next location. One may note that during unloading, ram plate 28 is in its locked passive, power off, position—namely fully advanced to the full extension of the rams, with plate 28 in a substantially vertical position.

It may be that apparatus 20 is normally stored within an enclosure, or hut, or fence, or other similar structure. For example at a fast food restaurant this fenced or boarded enclosure 196 may sit behind the restaurant or in the parking lot and the fence may keep apparatus 20 at least partially out of sight, and may, if provided with gates, also serve to keep out local scavengers such as coyotes, skunks, raccoons, sea gulls, deer and so on. Such huts may also include roofs or overhangs 198. In this kind of installation, back wall 44 is placed adjacent to the back or boundary wall 200 of the fixed structure and is therefore inaccessible.

The embodiments described herein may tend to permit relatively easy replacement and servicing. The units are entirely self-contained, and have a size and shape to remain within the physical envelope of existing non-compacting bins, and have the same lifting apparatus such that they are physically interchangeable with existing bins. Further, to the extent that servicing may be required, the construction is almost entirely modular. That is, the compactor assembly is built up as a single module, and can be removed and replaced as such. The electrical controller is modular, and is mounted on a hinged face plate to facilitate repair and maintenance. The motor installation is modular. Either can simply be removed and replaced. The unit has only a single point connection for power, and, if electrical or pneumatic, that connection is not one that is prone to leak oil or hydraulic fluid. The unit does not require an external compaction assembly, or an external motor that supplies pressurized hydraulic fluid to an on-board cylinder. Where an electrical connection is employed, that connection may be either a 240 or 110 VAC straight blade power connection. The connection may be on the truck driver's side (i.e., the left hand side) near the lid release lever, as this may tend to lessen the likelihood that the truck operator will forget to disconnect power before dumping. Further, the motor control may be a digital motor control, and may be a programmable motor control electrically connected to sense both operator inputs, door latching or unlatching inputs and feedback signals. Those feedback signals may include motor feedback parameters, such as motor frequency, current draw, output speed and output torque. The signals may also include hydraulic pressure and hydraulic pressure drop across the ram cylinders. The signals may further include a temperature sensor input or inputs, such as may indicate either freezing in the sump of fire in the bin, for example, or an electrical fault or discontinuity in the heater discussed below. The controller may communicate with external devices, whether to provide an alarm signal, e.g., in case of fire, or a fault signal for whatever reason, or a "bin full" signal to alert the user or the pick up agency that the bin requires emptying, or cannot accept further input material.

These bins are typically unloaded by a front loading truck. These are not, and are to be distinguished from, small bins or cans such as might be found in someone's apartment kitchen. These are industrial waste bins, sometimes referred to as "dumpsters" typically weighing well over 1000 lbs., and having a volume measured in cubic yards, not inches. An apparatus such as described, whether as small as 3 or 4 cubic yards, or the more customary nominal 6 cubic yard bin, is not intended to be lifted and dumped by hand. On the contrary, the bin may typically be of comparable height to a man. Units that have lifting fittings, such as the side-wall mounted slides or sockets, for engagement by the forks of a lift truck.

The front loading truck generally uses front facing forks, received within the lifting members or fittings of the 6-yard bin, to lift and invert the 6-yard bin above the truck, thereby emptying the contents of the bin into the truck for removal and disposal. A typical front loading truck has a maximum lifting weight. In one instance that weight may be of the order of 8,000 lbs. A 6-yard bin exceeding the maximum lifting weight of a front loading truck may not be emptied.

The unit is intended to, and may, achieve at least 4:1 compression of predominantly loose paper and plastic carton refuse, and is expected to achieve about 6:1 compression (+/−20%), and may possibly achieve 8:1 compression under some circumstances, e.g., where the initial density of the waste is very low. It may be that the effective compression that may be achieved may tend to be a function of the mix of materials rather more than the initial density prior to compaction. For a typical mixture of container refuse, such as fast food waste, it may be that final compaction density may be in the range of 500-1000 lbs per cubic yard, and perhaps more typically about 700-800 lbs per cubic yard, whatever the initial input density may be. Compression to this extent may reduce the number of garbage pick-ups required per week. Initial waste density is expected to be in the range of 65-80 kg/m$^3$ (very roughly, about 125 lbs per cubic yard), although in some instances this figure may be as low as about 75-80 lbs per cubic yard. The compression cycle time may be of the order of 50 seconds, the retraction cycle time may be of the order of 40 seconds, giving a full cycle time of about 1½ minutes, i.e., less than 2 minutes. The working pressure of the hydraulic cylinders may be about 2700 p.s.i., and the pump may have an operating pressure of up to 3000 p.s.i. The motor power may be about 1 kW (1⅓ hp.) On average, it is anticipated that the unit will operate twice per hour. The hydraulic pump may be driven either by an electric motor or by a pneumatic motor.

The presently described embodiments are intended to fit anywhere a nominally 6 cubic yard bin will fit. It may be noted that bin sizes vary slightly, so that a bin that is nominally a "6 yd." bin, may have an actual capacity of somewhat more, or possibly somewhat less, than precisely 6 cubic yards. In one embodiment the bin may have an actual capacity of about 6.2 cubic yards (4750 L). The useful capacity (bin inside envelope capacity of 6.2 cu. yds., less the volume occupied by the motor, rams, controls and unoccupied input chute) may be about, or somewhat under (e.g., 5.5-6.0 cu. yds. (+/−)). Generically, then, a nominal "6 yard bin" might be understood to have an actual capacity in the range of roughly 5 to 7 cubic yards, or thereabout.

Furthermore, unlike one known unit, access for operating the compaction unit is not on the back side of the bin (i.e., the truck approaches from the front side). That is, where access is from the rear of the bin, and the truck picks the bin up from the front side, any gated enclosure or shelter for the bin must be open or have gates on both sides to permit access to both sides. In the present unit, the access is not from the rear of the unit, but rather from the front of the unit, such that the unit can be parked in its shed, or garage, or enclosure, in the customary way: if the garbage truck has access to the bin, the operator also has access to the input chute.

The all up weight of the empty self-contained nominally "6 yd." unit may be less than 2900 lbs., (i.e., mass of less than 1300 kg), and may weigh less than 2500 lbs. In one embodiment, the total empty weight of the nominally 6 cubic yard unit may be about 2200-2300 lbs (i.e., mass of 1000 kg (+/−). The size of the nominally 6 cubic yard unit may be about 72 inches wide ($W_{20}$), 69 inches high ($h_{22}$), and 66 inches deep in the fore-and-aft direction ($L_{20}$). The unit will then fit within an overall space envelope of an overall height, including lid, of 80 inches; an overall width including lifting fittings of 82 inches, and an overall length front-to-rear of 72 inches. That is, in the embodiment illustrated, $L_{20}$ is substantially less than 84 inches, and quite a bit less than the 90 or more inch depth of a known back-loading unit in which the compaction apparatus extends outwardly from the back of the bin. By contrast, the compaction apparatus shown and described is mounted largely within, indeed, entirely within, the physical bin envelope defined by the main sheets of the enclosure assembly, those being the front, back, sides, top, and base. In some embodiments, when empty, and when full (assuming homogenous refuse density of 700-800 lbs/cu. yd.), the location of the center of gravity of the unit in the fore- and aft direction is less than ¾, and in some embodiments less than ⅔, of $L_{20}$ from the plane of front wall 42. Expressed differently, when full, the C of G may, in one embodiment, lie within ⅙ of $L_{20}$ of the mid-plane of the unit.

Further still, inasmuch as the lid is opened less often, (i.e., refuse is not being heaved or slung over the top margin and into the bin), and the door of the entrance chute is a controlled opening, there may be a tendency to a reduction in odors and pests.

Further still, the unit employs greaseless bushings, and places the motor, the electronic control unit, and the hydraulic cylinders at elevated locations relative to the inlet chute. The pins for the cylinders are located behind the ram, and, in normal operation, refuse should tend not tend to migrate behind the compression head. That is, none of the equipment is in a submerged or potentially immersed position relative to the refuse, whether in water or, more commonly, the often corrosive mixture or residue of ooze or slop of soft drinks, food waste, coffee, and so on that may tend to be typical at a fast food outlet. This may tend to reduce the exposure of the various parts and assemblies, and may reduce corrosion. It may also tend to improve ease of maintenance.

FIGS. 9*a* and 9*b* pertain to an embodiment of waste containment and compaction apparatus 220 that is substantially the same as that of FIG. 1*a*, except insofar as it is reversed. That is, rather than the top wall, i.e., lid 222, being hinged along the rear of the bin, it is hinged along front edge 224 i.e., on the main panel side on which objects are introduced at door 226. The lid or top panel release latch 228 (corresponding to 60) is accordingly relocated to the diagonally opposite rear location as shown in FIG. 9*b*. Further, the lifting fittings 230 (corresponding to 80) have been moved rearwardly, and the standoffs 232 (corresponding to 102) are mounted on the rear end of the bin, with appropriate modifications of the reinforcement beams, 234, 236 (corresponding to structural steel tube reinforcements 84, 86) such that the front face of the truck meets standoffs 232 in a substantially vertical plane on initial engagement.

Apparatus 220 may be suitable for use in an installation in which a restaurant has a garage attached to the rear of the building, for example. The loading door is accessible to restaurant employees on the front side 240 of the unit, while the back side faces the garage door. When the bin is full, the collection truck approaches from the garage door side, i.e., the back side, of the unit.

FIGS. 10*a*-10*d*, 11*a*, 11*b*, 12*a* and 12*b* all relate to another embodiment of waste containment and compaction apparatus, 250, that is substantially the same as apparatus 20., and may be taken as being the same except as indicated. It differs from that unit insofar as it has first and second internal flow enhancement members, or internal flow facilitation members 252, indicated as a first member 254 and a second member 256; and a drain system 260. Apparatus 250 also dispenses with the use of retention knives, such as knives or tines 126, although they may remain as an option.

As material builds up in apparatus 250, there may be a tendency for that material to compress in front of the ram 248. That is, the discharge from the compaction ram assembly may tend to compress, and build up in the immediate compaction discharge region indicated generally as 262, without necessarily spreading or compacting to a particularly even, or relatively even extent throughout the box. It may be that more even distribution and compaction of accumulated material may be obtained by encouraging the collected matter to roll back forward over the motor enclosure as it builds up, and to encourage it to have a lateral component of motion tending to urge material to move laterally into the other side of the bin. To that end first internal flow facilitation member 254, which may also be termed a compacted material distribution member, may be mounted within the bin carcase, or shell 264, generally in a position to intercept at least a portion of the material being urged into the storage chamber by ram assembly 266. In one embodiment member 254 has the form of a skirt, or chamfer, or vane, or deflector, or wedge, indicated as wall member 268, however it may be termed. Wall member 268 may be a curved plate. Alternatively, as shown, it may be a substantially planar sheet or plate member mounted, such as by welding, between rear panel 270 and left hand side panel 272 to define, or function as, a wedge member having a first angle, alpha, measured between vertical and the line of intersection of wall member 268 and left hand side panel 272. This angular inclination may tend to urge collected matter forced to ride thereagainst to be deflected back forward over the compaction unit housing 274. This wedge may also have a second angle, beta, as measured between vertical and the line of intersection of wall member 268 and rear panel 270. This angular inclination beta may tend to cause collected matter riding against plate 268 to be urged laterally within bin 264 toward right hand region 280. To the extent that member 268 has both alpha and beta angles (and is a substantially triangular plate, narrow at the low end, broad at the high end, tapering between the ends and inclined on a resultant compound angle relative to both panel 270 and panel 272) it may tend to impart both rear-to-front and lateral components of reaction and motion or compression on the accumulated material.

In due course, as material is urged laterally from discharge region 262 to right hand region 280, it may again tend to push along the walls and accumulate, and tend to build up in one place. However, member 256, which may have the form of either a flat plate or a curved vane or deflector welded on a corner chamfer or radius between rear panel 270 and right hand side wall panel 282, may tend to urge the accumulating material to turn the corner. That is to say, it may tend to work as a wedge or vane or deflector tending to provide a rear-to-front component of reaction or force, or motion to the accumulated material toward front panel 284 thus tending to cause it to fill in, and to more evenly compact in, right hand region 280. The face of member 256 may be planar, and may be at roughly 45 degrees to both panel 270 and panel 282 when viewed from above as in FIG. 10*d*. It may tend to meet the curved lower rear sheet 286 on a generally elliptic curve as shown.

There is the potential presence of liquids in the material to be compacted and accumulated. This liquid may include unconsumed soft drinks, coffee, tea, juices, milk, salad dressings, sauces, and so on. It may not be desirable for this liquid to collect in the sweep-out of the compaction ram, and it may not be desirable for it then to pour back our the front panel or the lid onto the waste collection truck or upon the truck operator. Apparatus 250 has a sweep-out plate 288 that has liquid egress ports, or apertures, or channels 290, that permit this liquid to flow into a collection conduit, or conduits, indicated generally as 292. There may be two conduits 292 spaced laterally generally to either lateral side of the sweep out, with the idea that even if apparatus 250 sits on a floor or other platform that is not level, one side or the other will drain. Each conduit 292 may include an inlet portion 294, which may have the form of a generally wedge shaped trough, 296 capped at one end and open at the other, welded to the underside of sweep out plate 288 to catch liquid dripping through ports 290; and a pipe portion 298 mounted to carry drippings from inlet portion 294 to a rearmost region underlying floor panel 300 of region 262. On each side there may be two or several drain holes formed along the arc of sweep-out plate 288, such that each cap-ended trough 296 is in effect an inlet manifold with a plurality of ports. As resistance to compaction becomes stronger as the bin is filled, the additional holes may tend to continue to permit liquid to drain away. The array of drain holes may extend over a range of perhaps 15-30 degrees of arc of sweep-out plate 288.

The entire bottom of apparatus 250 may include a liquid containing sump 310 bounded by a liquid containment bottom panel plate 302, and by front panel 304 which may also define a liquid containment barrier. Floor panel 300 may also have drain ports 306. Flow of collected material from the left hand side of the sump to the right hand side of the sump is facilitated by passages, or ports or slots 308 in the lower portion of intermediate wall 312 as shown in FIGS. 12*a* and 12*b*. The shallow downward front to rear slant of pipe portions 298 which may be of the order of a few degrees, e.g., less than 3 degrees, toward the rearmost distant region of the sump is intended to permit draining in normal use. However, when apparatus 250 is lifted by the collection truck, and even slightly titled clockwise as seen in FIGS. 12*a* and 12*b*, the discharge ends of pipe portions 298 will be at higher elevation than the liquid in the sump, which may tend to collect at the downhill end at front panel 304. Thus the liquid may tend not to flow back through pipe portions 298 toward sweep-out plate 288. Thus, in use, the drain is effectively a one-way flow device. Floor panel 312 of the right hand side region is also perforated, or ported, or porous, as at holes 314 to permit drainage into sump 310. Further, the front margin of floor panel 312 has discharge passages or ports or slots 316. When the bin is lifted to full height and rotated, slots 316 permit the liquid in the sump to follow the accumulated matter in region 262 into the collection truck. In a 6 cu. yard bin, sump 310 may have an overall volume of perhaps 200 liters (roughly 40-50 imp. gal.). This discharge may tend to occur after the accumulated material has been permitted to slide out first, as may occur only when the bin is dumped in the truck more generally.

In the event that apparatus 250 should be for operation in a cold climate, a thermal heating element 318 provides some heat to the sump to discourage freezing of the liquid. Heating element 318 may be an encased band or tape affixed to the underside of bottom panel 302. This may in turn be protected by a thick plastic or other suitable protection panel. The power for the heating element is provided through the same electrical power connection as that of the main battery.

As shown in FIGS. 11*a*, 11*b*, 12*a* and 12*b*, the ram drive motor, which may include an electric motor 320 driving an hydraulic pump 322, is mounted transversely (i.e., the axis of rotation of the motor is cross-wise to apparatus 250 when seen from in front of apparatus 250) on a motor base 324 located mid-way between hydraulic ram cylinders 330. Motor 320 and pump 322 are mounted on a vibration isolator, or isolators. Motor base 324 may also have predominantly triangular end closure walls 332, (near side plate removed in FIGS. 12*a* and 12*b*, with appropriate electrical and hydraulic line penetrations, such as may tend to discourage liquid squirting past ram plate 334 from collecting on motor base 324, motor 320, or pump 322.

Various embodiments of the invention have been described in detail. Since changes in and or additions to the above-described best mode may be made without departing from the nature, spirit or scope of the invention, the invention is not to be limited to those details but only by the appended claims.

We claim:

1. A waste containment apparatus comprising:

an enclosure, said enclosure having a bottom wall, a front wall, a rear wall, a first side wall, a second side wall, and a top wall;

said front wall, rear wall, first side wall and second side wall are arranged about said bottom wall and stand upwardly therefrom, said five walls collectively having an open-topped box form;

said rear wall, front wall, first side wall and second side wall each have an upper margin;

said upper margins of said front wall, rear wall, first side wall and second side wall cooperably defining a first opening;

said first opening having a bin lid opening sill, and a bin lid opening sill height;

said enclosure including an hinged top wall, said top wall being movable between open and closed positions to govern egress of waste from said enclosure when said enclosure is upended;

in said closed position said top wall being mated with said upper margins of said front wall, said rear wall, said first side wall and said second side wall, thereby closing said first opening;

said top wall being hingedly mounted along one of (a) said upper margin of said rear wall, and (b) said upper margin of said front wall;

said enclosure having external lifting fittings permitting a waste collection truck to lift, tip and empty said waste containment apparatus;

said external lifting fittings include a first lifting fitting mounted to said first side wall, and a second lifting fitting mounted to said second side wall;

said external lifting fittings being guides for a pair of forks of the waste collection truck;

a compactor, said compactor including a motor and a compactor head driven by said motor;

said compactor being mounted to said enclosure within said box form;

said enclosure defining a storage accommodation for compacted waste;

said compactor being operable at least partially to compact waste introduced into said enclosure;

said enclosure having a second opening defining a refuse entryway, said second opening defining an input threshold, at which a human user may introduce waste into said waste containment apparatus for compaction; and said input threshold having a lower height than said bin lid opening sill height.

2. The waste containment apparatus of claim 1 wherein said rear wall is free of refuse entryways.

3. The waste containment apparatus of claim 1 wherein said refuse entryway is defined in said front wall.

4. The waste containment apparatus of claim 3 wherein said rear wall is free of refuse entryways.

5. The waste containment apparatus of claim 1 wherein at least said motor is protected by an angled member mounted thereabove, said angled member being oriented to urge a cross-wise component of motion of waste within said enclosure.

6. The waste containment apparatus of claim 1 wherein said compactor is eccentrically mounted, said compactor being closer to said first side wall than to said second side wall.

7. The waste containment apparatus of claim 1 wherein said input threshold is less than 36 inches high.

8. The waste containment apparatus of claim 7 wherein said apparatus has any of:

(a) a bin lid opening sill, and said input threshold is one of (i) less than 24 inches high; and (ii) less than ⅖ of the height of the bin to the lid opening sill; and (b) a nominal capacity of 6 cu. yds., and an empty weight of less than 2900 lbs.

9. The waste containment apparatus of claim 1 wherein said apparatus has a fore-and-aft lid opening dimension, said lid being hingedly mounted to said rear wall, and, when fully laded, said apparatus has a fore-and-aft center of gravity location that is less than ¾ of said fore-and-aft lid opening dimension rearward of said front wall.

10. The waste containment apparatus of claim 1 wherein said apparatus has a liquid drain and a sump in which to collect drained liquid.

11. The waste containment apparatus of claim 1 wherein said apparatus has a sump heater.

12. A waste containment apparatus comprising:

an enclosure structure;

said enclosure having a front wall, a rear wall, a first side wall, a second side wall, and a top opening lid;

said rear wall, front wall, first side wall and second side wall each have an upper margin;

said upper margins of said front wall, rear wall, first side wall and second side wall cooperably defining a first opening;

said enclosure structure having lifting sockets for engagement by lifting forks of a waste collection truck bin lifting apparatus;

said enclosure has a base upon which it sits when not being lifted;

said top opening lid being matable with said first opening in a closed position thereof, said lid being operable to open when said enclosure is lifted and tipped by the waste collection truck bin lifting apparatus;

a compaction apparatus mounted to, and located within, the enclosure structure;

the compaction apparatus including a compaction ram;

the containment apparatus having an input receptacle region and a second opening by which a human user can introduce waste into said waste containment apparatus, said second opening being located at a lower height than said first opening; and, when said waste containment apparatus is sitting on said base, said compaction apparatus being mounted higher than said input receptacle region.

13. The waste containment apparatus of claim 12 wherein said compaction ram includes a pivoting ram plate, and said input receptacle region defines an arcuate chamber swept by said pivoting ram plate during operation thereof.

14. The waste containment apparatus of claim 12 wherein said enclosure structure has internal wall members shaped to urge refuse to follow a flow path to fill said containment apparatus.

15. The waste containment apparatus of claim 14 wherein at least one of:

(a) one of said wall members is arcuately curved to deflect refuse from an horizontal flow direction to a predominantly upward flow direction;

(b) one of said wall members is slanted cross-wise to urge the flow in a sideways direction to fill a side-ways adjacent portion of said enclosure; and (c) said containment apparatus enclosure has a front side and a rear side; and both said lifting apparatus and said input receptacle region have front side access.

16. The waste containment apparatus of claim 12 wherein:

said enclosure structure includes a first side wall, a second side wall, a top wall, a bottom wall, a rear wall, and a front wall, all co-operatively assembled to define a generally box-shaped structure having an internal volume of greater than 4 cubic yards;

said lifting sockets include lifting fittings mounted to said first and second sidewalls by which to raise and empty said enclosure structure; and said enclosure structure has a predominantly upwardly extending member, said member including any of (a) a curved vane;

(b) a deflector; and (c) a plate, and said member being mounted within said enclosure structure between said first sidewall and said rear wall.

17. The waste containment apparatus of claim 16 and wherein said waste containment also comprises a second predominantly upwardly extending member, said second upwardly extending member being one of (a) a curved vane; (b) a deflector; and (c) a plate, said second upwardly extending member being mounted between said second sidewall and said rear wall.

18. The waste containment apparatus of claim 17 wherein:

said first upwardly extending member is a substantially triangular plate that is oriented on a chamfer angle between said first side wall and said rear wall; said substantially triangular plate tapers from a narrow end and a wide end, said narrow end being closer to said bottom wall than is said wide end;

said second upwardly extending member is a plate that is oriented on a chamfer angle between said second side wall and said rear wall; and said second upwardly extending member lies at least predominantly in a vertical plane.

19. A waste containment apparatus comprising:

an enclosure, said enclosure having a bottom wall, a front wall, a rear wall, a first side wall, a second side wall, and a top wall;

said front wall, rear wall, first side wall and second side wall are arranged about said bottom wall and stand upwardly therefrom, said five walls collectively having an open-topped box form;

said rear wall, front wall, first side wall and second side wall each have an upper margin;

said upper margins of said front wall, rear wall, first side wall and second side wall cooperably defining an opening;

said first opening having a bin lid opening sill, and a bin lid opening sill height;

said enclosure including an hinged top wall, said top wall being movable between open and closed positions to govern egress of waste from said enclosure when said enclosure is upended;

in said closed position said top wall being mated with said upper margins of said front wall, said rear wall, said first side wall and said second side wall;

said top wall being hingedly mounted along one of (a) said upper margin of said rear wall, and (b) said upper margin of said front wall;

said enclosure having external lifting fittings permitting a waste collection truck to lift, tip and empty said waste containment apparatus;

said external lifting fittings include a first lifting fitting mounted to said first side wall, and a second lifting fitting mounted to said second side wall;

said external lifting fittings being guides for a pair of forks of the waste collection truck;

a compactor, said compactor including a motor and a compactor head driven by said motor;

said compactor being mounted to said enclosure within said box form;

said enclosure defining a storage accommodation for compacted waste; and said compactor being operable at least partially to compact waste introduced into said enclosure;

said apparatus has a refuse flow path;

said flow path includes an entrance at which refuse is placed within said enclosure;

there is a compaction zone in which refuse introduced at said entrance is acted upon by said compactor; and there is an accumulation zone toward which refuse is urged by action of said compactor.

20. The waste containment apparatus of claim 19 wherein said compactor has a line of action in a first plane and said apparatus includes at least one obliquely mounted member oriented to urge refuse to move out of that plane.

21. The waste containment apparatus of claim 19 wherein said enclosure has a first deflector plate and a second deflector plate, said first deflector plate being oriented to deflect material received from said compactor at least in part toward said second deflector plate.

22. A waste containment apparatus comprising:

an enclosure, said enclosure having a bottom wall, a front wall, a rear wall, a first side wall, a second side wall, and a top wall;

said front wall, rear wall, first side wall and second side wall are arranged about said bottom wall and stand upwardly therefrom, said five walls collectively having an open-topped box form;

said rear wall, front wall, first side wall and second side wall each have an upper margin;

said upper margins of said front wall, rear wall, first side wall and second side wall co-operably defining an opening;

said enclosure including an hinged top wall, said top wall being movable between open and closed positions to govern egress of waste from said enclosure when said enclosure is upended;

in said closed position said top wall being mated with said upper margins of said front wall, said rear wall, said first side wall and said second side wall;

said top wall being hingedly mounted along one of (a) said upper margin of said rear wall, and (b) said upper margin of said front wall;

said enclosure having external lifting fittings permitting a waste collection truck to lift, tip and empty said waste containment apparatus;

said external lifting fittings include a first lifting fitting mounted to said first side wall, and a second lifting fitting mounted to said second side wall;

said external lifting fittings being guides for a pair of forks of the waste collection truck;

a compactor, said compactor including a motor and a compactor head driven by said motor;

said compactor being mounted to said enclosure within said box form;

said enclosure defining a storage accommodation for compacted waste; and said compactor being operable at least partially to compact waste introduced into said enclosure;

said compactor is mounted to urge compacted material rearwardly above said bottom wall toward, and upwardly along, said rear wall; and said enclosure includes a first deflector member positioned to urge compacted material moving upwardly along said rear wall to move at least partially forwardly along said top wall.

23. The waste containment apparatus of claim 22 wherein: said first deflector member is positioned also to urge compacted material at least partially laterally across said enclosure, and said enclosure also has a second deflector member positioned to urge compacted material moving laterally along said rear wall to move at least partially forwardly away from said rear wall.

24. The waste containment apparatus of claim 22 wherein: said first deflector member is angled between one said sidewall and said rear wall, and said first deflector member tapers from a broad upper portion to a narrow lower portion whereby said first deflector member is positioned to impart a reaction on material urged against said plate, said reaction having a first component of force in a rear-to-front direction, and a second component of force in a sideways direction.

25. The waste containment apparatus of claim 22 wherein:

said first deflector member is angled between one said sidewall and said rear wall, and said first deflector member tapers from a broad upper portion to a narrow lower portion whereby said first deflector member is positioned to impart a reaction on material urged thereagainst, said reaction having a first component of force in a rear-to-front direction, and a second component of force in a sideways direction; and said enclosure includes a second member, and, when seen from above looking downward, said second member being angled between a said rear wall and a second of said sidewalls.

26. The waste containment apparatus of claim 6 wherein said compactor has a line of action that lies in a fore-and-aft plane generally parallel to said first side wall.

27. The waste containment apparatus of claim 26, the width of said box form is defined laterally between said first and second side walls, wherein said compactor and motor are mounted within said box form and offset to one side of center closer to said first side wall, said compactor is narrower than said box form, and said compactor is operable to urge waste to be distributed and compacted in the full width of said box form.

28. A waste containment and compaction apparatus comprising:

a receptacle having a box-shaped form, said receptacle having an upstanding front wall, rear wall, first side wall, and second side wall;

said front, rear, first side and second side walls each having upper margins, those upper margins co-operating to define a first opening of said box shaped receptacle;

said receptacle having a width;

said first and second side walls being spaced apart from each other width-wise;

said front wall and rear wall being spaced apart in a front-and-rear direction;

external lifting fittings mounted to said first and second side walls for accommodating lifting forks of a waste collection truck;

a lid hingedly mounted one of (a) said upper margin of said rear wall, and (b) said upper margin of said front wall; said lid being operable to open when said receptacle is upended by a waste collection truck lifting apparatus;

a compactor that includes a motor and a compactor head driven by said motor;

a second opening by which to introduce waste into said waste containment apparatus;

said compactor being mounted within said box shaped form, said compactor being positioned to act upon urge waste introduced at said second opening;

said compactor head acting in a front-and-rear plane;

said compactor head having a width that is a partial width of said receptacle.

29. The waste containment apparatus of claim 28 wherein said first opening has a sill height, and said second opening has a threshold height, and said threshold height is less than said sill height.

30. The waste containment apparatus of claim 29 wherein said threshold height is less than 36 inches high.

31. The waste containment apparatus of claim 28 wherein said compaction head is mounted asymmetrically to one side of said apparatus closer to said first side wall.

32. The waste containment apparatus of claim 31 wherein said compactor head is located in a half of said apparatus closest to said first side wall.

33. The waste containment apparatus of claim 32 wherein said receptacle includes an internal member positioned to encourage flow or waste along said lid when said lid is closed.

34. The waste containment apparatus of claim 33 wherein said receptacle includes an internal member positioned to urge widthwise motion of waste within said receptacle.

35. The waste containment apparatus of claim 32 wherein said receptacle includes an internal member positioned to urge widthwise motion of waste within said receptacle.

36. The waste containment apparatus of claim 28 wherein said first opening is defined in said front wall, and is located asymmetrically with respect thereto, being closer to said first side wall than to said second sidewall, said compaction head is mounted correspondingly asymmetrically relative to said front wall; and said motor is mounted higher than said second opening.

* * * * *